US010884346B2

(12) United States Patent
Miyamoto et al.

(10) Patent No.: US 10,884,346 B2
(45) Date of Patent: Jan. 5, 2021

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Eiichi Miyamoto, Osaka (JP); Hiroki Tsurumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 228 days.

(21) Appl. No.: 15/999,788

(22) PCT Filed: Jan. 30, 2017

(86) PCT No.: PCT/JP2017/003153

§ 371 (c)(1),
(2) Date: Aug. 20, 2018

(87) PCT Pub. No.: WO2017/141677

PCT Pub. Date: Aug. 24, 2017

(65) Prior Publication Data

US 2020/0201199 A1 Jun. 25, 2020

(30) Foreign Application Priority Data

Feb. 18, 2016 (JP) ..... 2016-028847

(51) Int. Cl.

| | |
|---|---|
| ***G03G 5/00*** | (2006.01) |
| ***G03G 5/047*** | (2006.01) |
| ***G03G 5/06*** | (2006.01) |

(52) U.S. Cl.

CPC ..... *G03G 5/047* (2013.01); *G03G 5/0614* (2013.01); *G03G 5/0637* (2013.01); *G03G 5/0696* (2013.01)

(58) Field of Classification Search

CPC ... G03G 5/0614; G03G 5/0607; G03G 5/0696

(Continued)

(56) References Cited

U.S. PATENT DOCUMENTS

| | | | | |
|---|---|---|---|---|
| 5,804,344 | A | 9/1998 | Mitsumori | |
| 6,030,734 | A | 2/2000 | Mitsumori | |
| 2016/0152556 | A1* | 6/2016 | Okada | G03G 5/0612 430/58.35 |

FOREIGN PATENT DOCUMENTS

| | | | |
|---|---|---|---|
| JP | H09-244278 | A | 9/1997 |
| JP | 2013-117572 | A | 6/2013 |

* cited by examiner

*Primary Examiner* — Mark A Chapman

(74) *Attorney, Agent, or Firm* — Studebaker & Brackett PC

(57) ABSTRACT

An electrophotographic photosensitive member (1) includes a conductive substrate (2) and a photosensitive layer (3). The photosensitive layer (3) is a single-layer photosensitive layer. The photosensitive layer (3) contains at least a charge generating material, a hole transport material, an electron transport material, and a binder resin. The charge generating material includes a metal-free phthalocyanine. The hole transport material includes a triphenylamine derivative represented by general formula (1) shown below. The electron transport material includes a quinone derivative represented by general formula (2) shown below. In general formula (1), $R^1$, $R^2$, $R^3$, m1, m2, k, p, and q are the same as those (Continued)

described in the description. In general formula (2), $R^4$, $R^5$, and $R^6$ are the same as those described in the description.
(1)
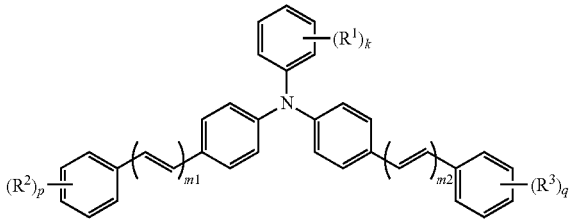
(2)
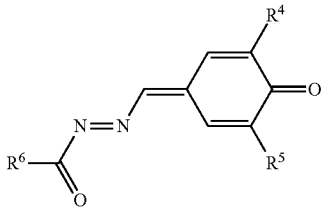
9 Claims, 4 Drawing Sheets
(58) Field of Classification Search
USPC ..... 430/78
See application file for complete search history.

ELECTROPHOTOGRAPHIC PHOTOSENSITIVE MEMBER, PROCESS CARTRIDGE, AND IMAGE FORMING APPARATUS

TECHNICAL FIELD

The present invention relates to an electrophotographic photosensitive member, a process cartridge, and an image forming apparatus.

BACKGROUND ART

Electrophotographic photosensitive members are used in electrographic image forming apparatuses. An electrophotographic photosensitive member includes a photosensitive layer. The photosensitive layer contains for example a charge generating material, a charge transport material (for example, a hole transport material and an electron transport material), and a resin (binder resin) that bonds them together. The photosensitive layer may contain both the charge generating material and the charge transport material to serve as a single layer functioning to generate and transport charge. An electrophotographic photosensitive member such as above is called a single-layer electrophotographic photosensitive member.

An electrophotographic photosensitive member disclosed in Patent Literature 1 includes a charge transport layer that contains an arylamine-based compound (specifically, a diamine compound). Patent Literature 1 also discloses a compound represented by chemical formula (HT-23).

(HT-23)

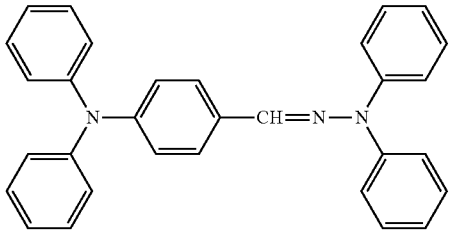

An electrophotographic photosensitive member disclosed in Patent Literature 2 includes a charge transport layer that contains a phenylbenzofuranone derivative (specifically, a naphthoquinone compound). Patent Literature 2 also discloses a compound represented by chemical formula (ET-2).

(ET-2)

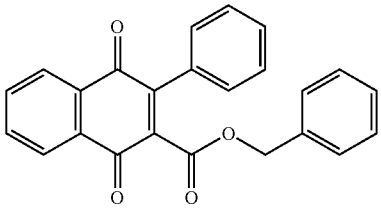

CITATION LIST

Patent Literature

[Patent Literature 1]
Japanese Patent Application Laid-Open Publication No. H9-244278
[Patent Literature 2]
Japanese Patent Application Laid-Open Publication No. 2013-117572

SUMMARY OF INVENTION

Technical Problem

However, electrical characteristics (charge stability, sensitivity characteristics, and ability to inhibit transfer memory) are not satisfactory in the electrophotographic photosensitive members disclosed in Patent Literatures 1 and 2.

The present invention has been made in view of the foregoing and has its object of providing an electrophotographic photosensitive member excellent in electrical characteristics. The present invention has another object of providing a process cartridge and an image forming apparatus in which occurrence of an image defect can be inhibited through inclusion of an electrophotographic photosensitive member such as above.

Solution to Problem

An electrophotographic photosensitive member according to the present invention includes a conductive substrate and a photosensitive layer. The photosensitive layer is a single-layer photosensitive layer. The photosensitive layer contains at least a charge generating material, a hole transport material, an electron transport material, and a binder resin. The charge generating material includes a metal-free phthalocyanine. The hole transport material includes a triphenylamine derivative represented by general formula (1) shown below. The electron transport material includes a quinone derivative represented by general formula (2) shown below.

(1)

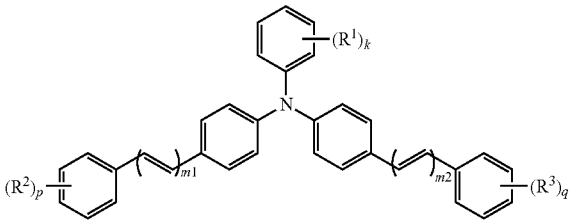

In general formula (1), $R^1$, $R^2$, and $R^3$ each represent, independently of one another, an alkyl group having a carbon number of at least 1 and no greater than 4 or an alkoxy group having a carbon number of at least 1 and no greater than 4. k, p, and q each represent, independently of one another, an integer of at least 0 and no greater than 5. m1 and m2 each represent, independently of one another, an integer of at least 1 and no greater than 3. When k represents an integer of at least 2, chemical groups $R^1$ may be the same as or different from one another. When k represents an integer of at least 2, the chemical groups $R^1$ may be bonded together to form a cycloalkyl ring having a carbon number of at least 3 and no greater than 8. When p represents an integer of at least 2, chemical groups $R^2$ may be the same as or different from one another. When q represents an integer of at least 2, chemical groups $R^3$ may be the same as or different from one another.

(2)

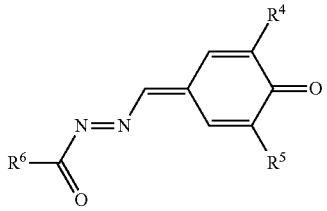

In general formula (2), $R^4$ and $R^5$ each represent, independently of one another, an alkyl group having a carbon number of at least 1 and no greater than 10 and optionally having an aryl group having a carbon number of at least 6 and no greater than 14, a cycloalkyl group having a carbon number of at least 3 and no greater than 10, an alkoxy group having a carbon number of at least 1 and no greater than 6, or an optionally substituted aryl group having a carbon number of at least 6 and no greater than 14. $R^6$ represents an alkyl group having a carbon number of at least 1 and no greater than 10 and optionally having an aryl group having a carbon number of at least 6 and no greater than 14, a cycloalkyl group having a carbon number of at least 3 and no greater than 10, an alkoxy group having a carbon number of at least 1 and no greater than 6, an optionally substituted aryl group having a carbon number of at least 6 and no greater than 14, or an optionally substituted heterocyclic group.

A process cartridge according to the present invention includes the above-described electrophotographic photosensitive member.

An image forming apparatus according to the present invention includes an image bearing member, a charger, a light exposure section, a development section, and a transfer section. The image bearing member is the above-described electrophotographic photosensitive member. The charger charges a surface of the image bearing member. The charger has a positive charging polarity. The light exposure section exposes the surface of the image bearing member to light while the surface of the image bearing member is charged to form an electrostatic latent image on the surface of the image bearing member. The development section develops the electrostatic latent image into a toner image. The transfer section transfers the toner image from the image bearing member to a transfer target.

Advantageous Effects of Invention

According to the electrophotographic photosensitive member of the present invention, electrical characteristics can be improved. Further, occurrence of an image defect can be inhibited in the process cartridge and the image forming apparatus according to the present invention through inclusion of an electrophotographic photosensitive member as above.

DESCRIPTION OF EMBODIMENTS

Figure 1A:
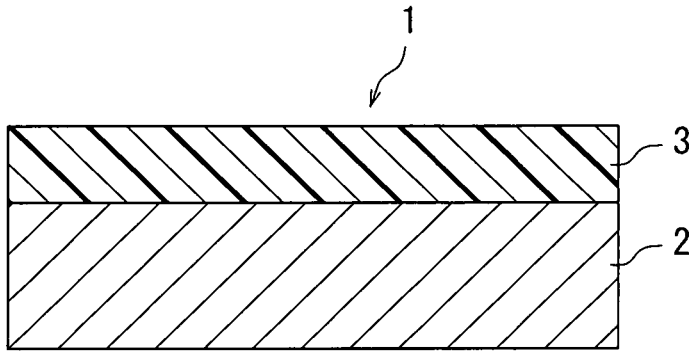
FIG. 1A is a schematic cross-sectional view illustrating a structure of an electrophotographic photosensitive member according to a first embodiment.

Embodiments of the present invention will be described below in detail. The present invention is not in any way limited by the following embodiments. The present invention can be practiced within a scope of objects of the present invention with alterations made as appropriate. Although explanation is omitted as appropriate in order to avoid repetition, such omission does not limit the essence of the present invention.

In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

In the following description, a halogen atom, an alkyl group having a carbon number of at least 1 and no greater than 10, an alkyl group having a carbon number of at least 1 and no greater than 6, an alkyl group having a carbon number of at least 1 and no greater than 4, an alkyl group having a carbon number of at least 1 and no greater than 3, an alkoxy group having a carbon number of at least 1 and no greater than 6, an alkoxy group having a carbon number of at least 1 and no greater than 4, an alkoxy group having a carbon number of at least 1 and no greater than 3, an aryl group having a carbon number of at least 6 and no greater than 14, a cycloalkyl group having a carbon number of at least 3 and no greater than 10, a cycloalkyl ring having a carbon number of at least 3 and no greater than 8, and a heterocyclic group indicate the followings, unless otherwise stated.

Examples of halogen atoms include a fluorine atom, a chlorine atom, a bromine atom, and an iodine atom.

The alkyl group having a carbon number of at least 1 and no greater than 10 is an unsubstituted linear or branched alkyl group. Examples of alkyl groups having a carbon number of at least 1 and no greater than 10 include a methyl group, an ethyl group, an n-propyl group, an isopropyl group, an n-butyl group, an s-butyl group, a t-butyl group, a pentyl group, an isopentyl group, a neopentyl group, a hexyl group, a heptyl group, an octyl group, a nonyl group, and a decyl group.

The alkyl group having a carbon number of at least 1 and no greater than 6 is an unsubstituted linear or branched alkyl group. Examples of alkyl groups having a carbon number of at least 1 and no greater than 6 include a methyl group, an ethyl group, an n-propyl group, an isopropyl group, an n-butyl group, an s-butyl group, a t-butyl group, a pentyl group, an isopentyl group, a neopentyl group, and a hexyl group.

The alkyl group having a carbon number of at least 1 and no greater than 4 is an unsubstituted linear or branched alkyl group. Examples of alkyl groups having a carbon number of at least 1 and no greater than 4 include a methyl group, an ethyl group, an n-propyl group, an isopropyl group, an n-butyl group, an s-butyl group, and a t-butyl group.

The alkyl group having a carbon number of at least 1 and no greater than 3 is an unsubstituted linear or branched alkyl group. Examples of alkyl groups having a carbon number of at least 1 and no greater than 3 include a methyl group, an ethyl group, an n-propyl group, and an isopropyl group.

The alkoxy group having a carbon number of at least 1 and no greater than 6 is an unsubstituted linear or branched alkoxy group. Examples of alkoxy groups having a carbon number of at least 1 and no greater than 6 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, and a hexyloxy group.

The alkoxy group having a carbon number of at least 1 and no greater than 4 is an unsubstituted linear or branched alkoxy group. Examples of alkoxy groups having a carbon number of at least 1 and no greater than 4 include a methoxy group, an ethoxy group, an n-propoxy group, an isopropoxy group, an n-butoxy group, an s-butoxy group, and a t-butoxy group.

The alkoxy group having a carbon number of at least 1 and no greater than 3 is an unsubstituted linear or branched alkoxy group. Examples of alkoxy groups having a carbon number of at least 1 and no greater than 3 include a methoxy group, an ethoxy group, an n-propoxy group, and an isopropoxy group.

The aryl group having a carbon number of at least 6 and no greater than 14 is an unsubstituted aryl group. Examples of aryl groups having a carbon number of at least 6 and no greater than 14 include an unsubstituted monocyclic aromatic hydrocarbon group having a carbon number of at least 6 and no greater than 14, an unsubstituted fused bicyclic aromatic hydrocarbon group having a carbon number of at least 6 and no greater than 14, and an unsubstituted fused tricyclic aromatic hydrocarbon group having a carbon number of at least 6 and no greater than 14. Examples of aryl groups having a carbon number of at least 6 and no greater than 14 include a phenyl group, a naphthyl group, an anthryl group, and a phenanthryl group.

The cycloalkyl group having a carbon number of at least 3 and no greater than 10 is an unsubstituted cycloalkyl group. Examples of cycloalkyl groups having a carbon number of at least 3 and no greater than 10 include a cyclopropyl group, a cyclobutyl group, a cyclopentyl group, a cyclohexyl group, a cycloheptyl group, a cyclooctyl group, a cyclononyl group, and a cyclodecyl group.

The alkyl ring having a carbon number of at least 3 and no greater than 8 is an unsubstituted alkyl ring. Examples of alkyl rings having a carbon number of at least 3 and no greater than 10 include a cyclopropane ring, a cyclobutane ring, a cyclopentane ring, a cyclohexane ring, a cycloheptane ring, and a cyclooctane ring.

The heterocyclic group is an unsubstituted heterocyclic group. Examples of heterocyclic groups include: a heterocyclic group formed by a five- or six-membered aromatic monocyclic ring including at least one (preferably, at least 1 and no greater than 3) hetero atom; a heterocyclic group formed by such monocyclic rings fused together; and a heterocyclic group formed by such a monocyclic ring and a five- or six-membered hydrocarbon ring fused together. The hetero atom includes at least one atom selected from the group consisting of a nitrogen atom, a sulfur atom, and an oxygen atom. Specific examples of heterocyclic groups include a thiophenyl group, a furanyl group, a pyrrolyl group, an imidazolyl group, a pyrazolyl group, an isothiazolyl group, an isoxazolyl group, an oxazolyl group, an isoxazolyl group, a thiazolyl group, an isothiazolyl group, a furazanyl group, a pyranyl group, a pyridyl group, a pyridazinyl group, a pyrimidinyl group, a pyrazinyl group, an indolyl group, a 1H-indazolyl group, an isoindolyl group, a chromenyl group, a quinolinyl group, an isoquinolinyl group, a purinyl group, a pteridinyl group, a triazolyl group, a tetrazolyl group, a 4H-quinolizinyl group, a naphthyridinyl group, a benzofuranyl group, a 1,3-benzodioxolyl group, a benzoxazolyl group, a benzothiazolyl group, and a benzimidazolyl group.

First Embodiment: Electrophotographic Photosensitive Member

Figure 1B:
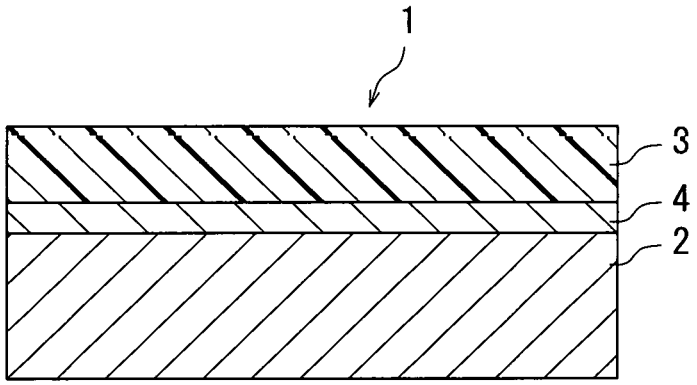
FIG. 1B is a schematic cross-sectional view illustrating another structure of the electrophotographic photosensitive member according to the first embodiment.
Figure 1C:
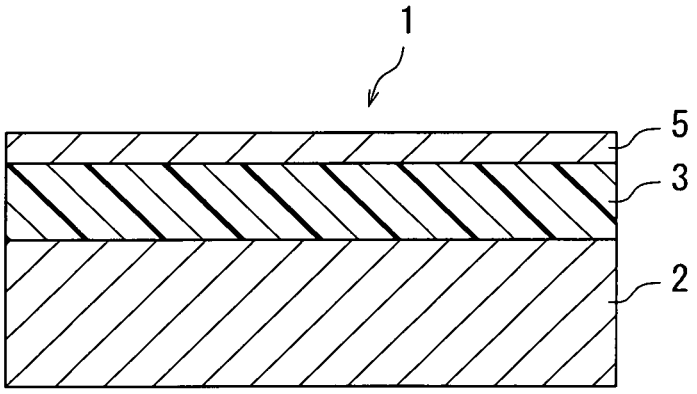
FIG. 1C is a schematic cross-sectional view illustrating still another structure of the electrophotographic photosensitive member according to the first embodiment.

A first embodiment relates to an electrophotographic photosensitive member (also referred to below as a photosensitive member). The following describes the photosensitive member according to the first embodiment with reference to FIGS. 1A to 1C. FIGS. 1A to 1C are schematic cross-sectional views each illustrating a structure of the photosensitive member according to the first embodiment.

As illustrated in FIG. 1A, a photosensitive member 1 includes a conductive substrate 2 and a photosensitive layer 3. The photosensitive layer 3 is a single-layer photosensitive layer. The photosensitive layer 3 is disposed directly or indirectly on the conductive substrate 2. The photosensitive layer 3 may be for example disposed directly on the conductive substrate 2, as illustrated in FIG. 1A. Alternatively, the photosensitive member 1 may additionally include an intermediate layer and the intermediate layer 4 may be disposed between the conductive substrate 2 and the photosensitive layer 3, as illustrated in FIG. 1B. The photosensitive layer 3 may be exposed as an outermost layer, as illustrated in FIGS. 1A and 1B. The photosensitive member 1 may further include a protective layer. A protective layer 5 may be disposed on the photosensitive layer 3, as illustrated in FIG. 1C. Through the above, the structures of the photosensitive member 1 are described with reference to FIGS. 1A to 1C.

No specific limitations are placed on thickness of the photosensitive layer other than enabling the photosensitive layer to function sufficiently as a photosensitive layer. The photosensitive layer preferably has a thickness of at least 5 μm and no greater than 100 μm, and more preferably at least 10 μm and no greater than 50 μm.

The photosensitive layer contains at least a charge generating material, a hole transport material, an electron transport material, and a binder resin. The charge generating material includes a metal-free phthalocyanine. The hole transport material includes a triphenylamine derivative represented by general formula (1) (also referred to below as a triphenylamine derivative (1)). The electron transport material includes a quinone derivative represented by general formula (2) (also referred to below as a quinone derivative (2)). The photosensitive member according to the first embodiment is excellent in electrical characteristics. Presumably, the reason therefor is as follows. Note that the electrical characteristics in the present description refer collectively to a characteristic (charge stability) capable of maintaining surface potential in charging, a characteristic (sensitivity characteristic) capable of efficient use of exposure light for electrostatic latent image formation, and a characteristic capable of preventing occurrence of transfer memory.

Transfer memory is first described in order to facilitate explanation. In electrographic image formation, a process of forming an image for example including the following steps 1) to 4) is performed:

1) a charging step of charging a surface of an image bearing member (corresponding to a photosensitive member);

2) a light exposure step of exposing the surface of the image bearing member to light while the surface of the image bearing member is charged to form an electrostatic latent image on the surface thereof;

3) a development step of developing the electrostatic latent image into a toner image; and 4) a transfer step of transferring the formed toner image from the image bearing member to a transfer target.

In a process of forming an image such as above, in which the image bearing member is rotated, transfer memory may be caused in the transfer step. The following provides a more specific explanation. In the charging step, the surface of the image bearing member is uniformly charged to a specific positive potential. Following the subsequent light exposure step and development step, a transfer bias of opposite polarity (negative polarity) to that in the aforementioned charging is applied to the image bearing member via the transfer target during the transfer step. Specifically, under influence of the applied transfer bias of opposite polarity, potential of a non-exposed region (region where no image is formed) of the surface of the image bearing member may significantly decrease and the decreased potential may be kept. As a result of potential decrease, the non-exposed region is hardly charged to a desired potential of positive polarity in the charging step for the next rotation of the photosensitive member subsequent to a reference rotation of the photosensitive member that is a rotation thereof for forming some image. By contrast, even when transfer bias is applied, the transfer bias is hardly applied directly to the surface of the photosensitive member in the presence of toner attached to an exposed region thereof. Therefore, the potential in the exposed region (region where an image is formed) hardly decreases. For the reason as above, the exposed region tends to be charged up to a desired potential of positive polarity in the charging step for the next rotation to the reference rotation. As a result, the charge potential differs between the exposed region and the non-exposed region. This may result in difficulty in uniformly charging the surface of the image bearing member to a specific potential of positive polarity. As described above, charge ability of the non-exposed region decreases under influence of potential decrease by the transfer bias in an imaging process (process of forming an image) for the reference rotation (previous rotation) of the photosensitive member to cause potential difference in charge potential. Such a phenomenon is called transfer memory. As described above, charge ability of the non-exposed region decreases under influence of potential decrease by the transfer bias in an imaging process (process of forming an image) for the reference rotation of the photosensitive member to cause potential difference in charge potential. Such a phenomenon is called transfer memory.

The triphenylamine derivative (1) has a structure in which one phenyl group and two diphenylalkenyl moieties are bonded to a nitrogen atom. The triphenylamine derivative (1) has a π-conjugated system of which spatial expanse is comparatively wide, and therefore, a movement distance of a carrier (holes) within a molecule of the triphenylamine derivative (1) tends to be long. That is, the movement distance of the carrier (holes) tends to be long. Furthermore, π-conjugated systems of respective molecules of the triphenylamine derivative (1) in the photosensitive layer tend to overlap with one another with a result that the movement distance of the carrier (holes) among molecules of the triphenylamine derivative (1) tends to decrease. That is, inter-molecule movement distance of the carrier (holes) tends to decrease. By contrast, each molecule of the triphenylamine derivative (1) includes one nitrogen atom. Therefore, less charge localization in molecules tends to occur when compared to a compound (for example, a diamine compound) having molecules each having two nitrogen atoms. Therefore, the triphenylamine derivative (1) is thought to improve receptivity (introducing ability) and transportability of the carrier (holes) of the photosensitive member.

The quinone derivative (2) has a π-conjugated system formed from a carbonyl moiety, an azo moiety, and a benzoquinone methide moiety. The π-conjugated system of the quinone derivative (2) has comparatively wide spatial expanse. Therefore, the quinone derivative (2) is excellent in receptivity of a carrier (electrons), and the movement distance of the carrier (electrons) within a molecule of the quinone derivative (2) tends to be long. That is, inter-molecule movement distance of the carrier (electrons) tends to be long. Furthermore, π-conjugated systems of respective molecules of the quinone derivative (2) in the photosensitive layer tend to overlap with one another with a result that the movement distance of the carrier (electrons) among molecules of the quinone derivative (2) tends to decrease. That is, inter-molecule movement distance of the carrier (electrons) tends to decrease. By contrast, the quinone derivative (2), which has an asymmetric structure in which the methide moiety and the azo moiety are bonded to each other, tends to readily dissolve in a solvent for photosensitive layer formation and tends to uniformly disperse in the photosensitive layer. For the reason as above, the inter-molecule movement distance of the carrier (electrons) tends to decrease. Therefore, the quinone derivative (2) is thought to improve receptivity (introducing ability) and transportability of the carrier (electrons) of the photosensitive member.

When the photosensitive layer contains a metal-free phthalocyanine as a charge generating material, the triphenylamine derivative (1) as a hole transport material, and the quinone derivative (2) as an electron transport material, the carriers have a tendency to be hardly trapped and remain in the photosensitive layer. Accordingly, it is thought that the photosensitive member according to the first embodiment is capable of preventing occurrence of transfer memory and excellent in charge stability and sensitivity characteristics, that is, excellent in electrical characteristics.

Components of the photosensitive member will be described below. The following describes the conductive substrate, the charge generating material, the hole transport material, the electron transport material, and the binder resin. The photosensitive layer may further contain an additive. The additive, the intermediate layer, and a photosensitive member production method will be described in addition.

[1. Conductive Substrate]

No specific limitations are placed on the conductive substrate other than being useable as a conductive substrate of a photosensitive member. It is only required that at least a surface portion of the conductive substrate is made from a conductive material. A conductive substrate made from a conductive material is an example of the conductive substrate. Another example of the conductive substrate is a conductive substrate covered with a conductive material. Examples of conductive materials include aluminum, iron, copper, tin, platinum, silver, vanadium, molybdenum, chromium, cadmium, titanium, nickel, palladium, and indium. One of the conductive materials listed above may be used independently, or two or more of the conductive materials listed above may be used in combination. Examples of combinations of two or more of the conductive materials include alloys (specific examples include aluminum alloys, stainless steel, and brass). Among the conductive materials listed above, aluminum or an aluminum alloy is preferable in terms of excellent mobility of charge from the photosensitive layer to the conductive substrate.

The shape of the conductive substrate can be selected as appropriate according to a configuration of an image forming apparatus in which the conductive substrate is to be used. Examples of the shape of the conductive substrate include a sheet-like shape and a drum-like shape. The thickness of the conductive substrate is selected as appropriate according to the shape of the conductive substrate.

[2. Charge Generating Material]

The charge generating material includes a metal-free phthalocyanine. Examples of crystalline metal-free phthalocyanines include a metal-free phthalocyanine having an X-form crystal structure (also referred to below as an X-form metal-free phthalocyanine). The metal-free phthalocyanine is represented by for example chemical formula (CG-1).

(CG-1)

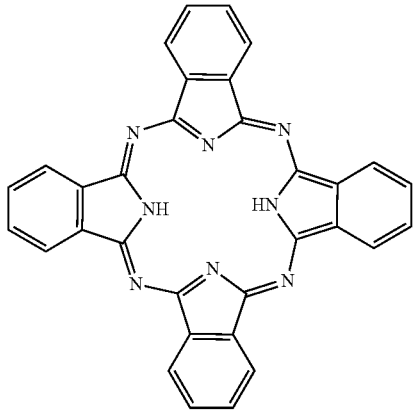

The charge generating material may include a charge generating material other than the metal-free phthalocyanine. Examples of charge generating materials other than the metal-free phthalocyanine include phthalocyanine-based pigments (additional phthalocyanine-based pigments other than the metal-free phthalocyanine), perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium salts, anthanthrone-based pigments, triphenylmethane-based pigments, threne-based pigments, toluidine-based pigments, pyrazoline-based pigments, and quinacridone-based pigments.

Examples of the additional phthalocyanine-based pigments include metal phthalocyanines. Examples of metal phthalocyanines include a titanyl phthalocyanine represented by chemical formula (CG-2) and phthalocyanines to which a metal other than titanium oxide is coordinated (specific examples include V-form hydroxygallium phthalocyanine). The phthalocyanine-based pigments may be crystalline or non-crystalline. No particular limitations are placed on the crystal structure (examples include) of the phthalocyanine-based pigments, and phthalocyanine-based pigments having various different crystal structures may be used.

(CG-2)

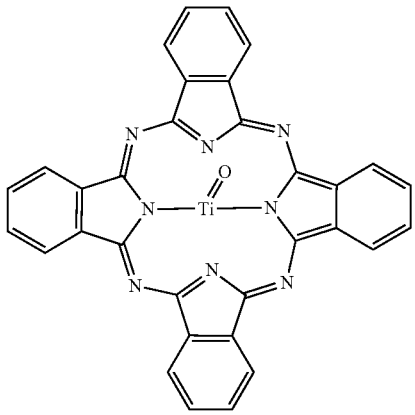

Titanyl phthalocyanine may for example have a crystal structure of α-form, β-form, or Y-form. Hereinafter, titanyl phthalocyanines having crystal structures of α-form, β-form, and Y-form may be referred to as α-form titanyl phthalocyanine, β-form titanyl phthalocyanine, and Y-form titanyl phthalocyanine, respectively. Y-form titanyl phthalocyanine, which has a high quantum yield within a wavelength range of at least 700 nm, is preferable among all titanyl phthalocyanines.

Y-form titanyl phthalocyanine exhibits for example a main peak at a Bragg angle (2θ±0.2°) of 27.2° in a CuKα characteristic X-ray diffraction spectrum. The term main peak refers to a most intense or second most intense peak within a range of Bragg angles (2θ±0.2°) from 3° to 40° in the CuKα characteristic X-ray diffraction spectrum.

(Method for Measuring CuKα Characteristic X-Ray Diffraction Spectrum)

The following describes an example of methods for measuring a CuKα characteristic X-ray diffraction spectrum. A sample (titanyl phthalocyanine) is loaded into a sample holder of an X-ray diffraction spectrometer (for example, "RINT (registered Japanese trademark) 1100", product of Rigaku Corporation), and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is for example from 3° to 40° (start angle: 3°, stop angle: 40°), and the scanning speed is for example 10°/minute.

Y-form titanyl phthalocyanine such as above is divided into three types according to difference in thermoprofile (specifically the following thermoprofiles (A) to (C)) indicated in a differential scanning calorimetry (DSC) spectrum.

Thermoprofile (A): In a thermal characteristic measured by DSC, one peak is present in a range from 50° C. to 270° C. other than a peak resulting from vaporization of adsorbed water.

Thermoprofile (B): In the thermal characteristic measured by DSC, a peak is not present in a range from 50° C. to 400° C. other than a peak resulting from vaporization of adsorbed water.

Thermoprofile (C): In the thermal characteristic measured by DSC, a peak is not present in a range from 50° C. to 270° C. other than a peak resulting from vaporization of adsorbed water and one peak is present in a range from 270° C. to 400° C.

(Method for Measuring Differential Scanning calorimetry)

The following describes an example of methods for measuring a differential scanning calorimetry spectrum. An evaluation sample powder of titanyl phthalocyanine crystals is placed on a sample pan, and a differential scanning calorimetry spectrum is measured using a differential scanning calorimeter (for example, "TAS-200 Type DSC8230D", product of Rigaku Corporation). A measurement range is for example from 40° C. to 400° C., and a heating rate is for example 20° C./minute.

A Y-form titanyl phthalocyanine having the thermoprofile (B) or (C), which is excellent in crystalline stability, which hardly causes crystal dislocation in an organic solvent, and which readily disperses in a photosensitive layer, is preferable.

One charge generating material having a desired absorption wavelength range may be used independently, or two or more of such charge generating materials may be used in combination. Furthermore, it is preferable to use a photosensitive member having sensitivity in a wavelength range of at least 700 nm in digital optical image forming apparatuses. Examples of digital optical image forming apparatuses include laser beam printers and facsimile machines that use a light source such as a semiconductor laser. In view of the foregoing, phthalocyanine-based pigments are preferable and a metal-free phthalocyanine or a titanyl phthalocyanine is more preferable. One charge generating material may be used independently, or two or more charge generating materials may be used in combination.

In a case where the photosensitive member is adopted in an image forming apparatus including a short-wavelength laser light source, an anthanthrone-based pigment or a perylene-based pigment is preferably used as the charge generating material. The wavelength of the short-wavelength laser light is for example at least 350 nm and no greater than 550 nm.

The amount of the charge generating material is preferably at least 0.1 parts by mass and no greater than 50 parts by mass relative to 100 parts by mass of the binder resin in the photosensitive layer, and more preferably at least 0.5 parts by mass and no greater than 30 parts by mass.

[3. Hole Transport Material]

The hole transport material includes the triphenylamine derivative (1). The triphenylamine derivative is represented by general formula (1).

(1)

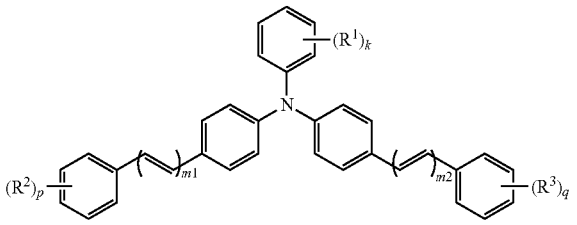

In general formula (1), $R^1$, $R^2$, and $R^3$ each represent, independently of one another, an alkyl group having a carbon number of at least 1 and no greater than 4 or an alkoxy group having a carbon number of at least 1 and no greater than 4. k, p, and q each represent, independently of one another, an integer of at least 0 and no greater than 5. m1 and m2 each represent, independently of one another, an integer of at least 1 and no greater than 3. When k represents an integer of at least 2, chemical groups $R^1$ may be the same as or different from one another. When k represents an integer of at least 2, the chemical groups $R^1$ may be bonded together to form a cycloalkyl ring having a carbon number of at least 3 and no greater than 8. When p represents an integer of at least 2, chemical groups $R^2$ may be the same as or different from one another. When q represents an integer of at least 2, chemical groups $R^3$ may be the same as or different from one another.

In general formula (1), preferably, alkyl groups having a carbon number of at least 1 and no greater than 4 and represented by $R^1$ each are any of a methyl group, an ethyl group, and an n-butyl group, or are bonded together to form a cycloalkane ring. Examples of cycloalkane rings that may be formed through the chemical groups $R^1$ being bonded together include a cycloalkane ring having a carbon number of at least 3 and no greater than 8, and a cyclohexane ring is preferable. An alkoxy group having a carbon number of at least 1 and no greater than 4 and represented by $R^1$ in general formula (1) is preferably an alkoxy group having a carbon number of at least 1 and no greater than 3, and more preferably a methoxy group.

A methyl group is preferable as an alkyl group having a carbon number of at least 1 and no greater than 4 and represented by $R^2$ or $R^3$ in general formula (1).

In general formula (1), the substitution position of $R^1$ is for example an ortho position, a meta position, or a para position of the phenyl group relative to the nitrogen atom. When k represents 1, the substitution position of $R^1$ is preferably an ortho position or a para position of the phenyl group relative to the nitrogen atom. When k represents 2 and two chemical groups $R^1$ are not bonded together to form a cycloalkane ring, the substitution position of each chemical groups $R^1$ is preferably an ortho position of the phenyl group relative to the nitrogen atom. When k represents 3 and two of three chemical groups $R^1$ are not bonded together to form a cycloalkane ring, the substitution position of each of the three chemical groups $R^1$ is preferably an ortho position and a para position of a benzene ring relative to the nitrogen atom. k preferably represents an integer of at least 1 and no greater than 3, and more preferably 1 or 2.

In general formula (1), p and q each preferably represent, independently of one another, 0 or 1 and it is more preferable that p and q simultaneously represent 0 or 1. When p represents 1, the substitution position of $R^2$ is preferably a para position of a phenyl group relative to the nitrogen atom. When q represents 1, the substitution position of $R^3$ is preferably a para position of a phenyl group relative to the nitrogen atom.

In general formula (1), m1 and m2 each preferably represent, independently of one another, 1 or 2 and it is preferable that m1 and m2 simultaneously represent 1 or 2.

In general formula (1), it is preferable that: $R^1$ represents an alkyl group having a carbon number of at least 1 and no greater than 4, an alkoxy group having a carbon number of at least 1 and no greater than 4, or chemical groups $R^1$ are bonded together to form a cycloalkane ring having a carbon number of at least 3 and no greater than 8; $R^2$ and $R^3$ each represent an alkyl group having a carbon number of at least 1 and no greater than 3; k represents an integer of at least 1 and no greater than 3; p and q each represent, independently of one another, 0 or 1; and m1 and m2 each represent, independently of one another, 1 or 2.

In general formula (1), it is more preferable that: $R^1$ represents an alkyl group having a carbon number of at least 1 and no greater than 4 or an alkoxy group having a carbon number of at least 1 and no greater than 3; k represents 1 or 2; $R^2$ and $R^3$ simultaneously represent an alkyl group having a carbon number of at least 1 and no greater than 3; p and q simultaneously represent 0 or 1; and m1 and m2 simultaneously represent 0 or 1.

Specific examples of the triphenylamine derivative (1) include triphenylamine derivatives represented by chemical formulas (HT-1) to (HT-13) (also referred to below as triphenylamine derivatives (HT-1) to (HT-13), respectively). In chemical formulas (HT-1) to (HT-13), "n-$C_4H^9$" represents an n-butyl group.

(HT-1)

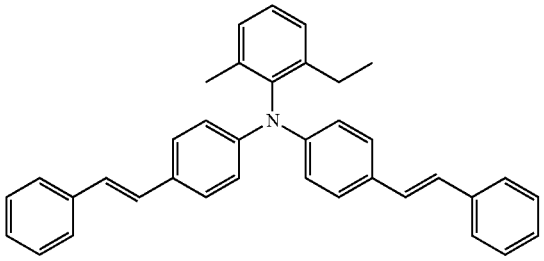

(HT-2)

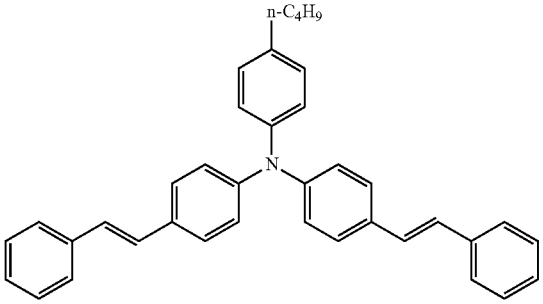

(HT-3)

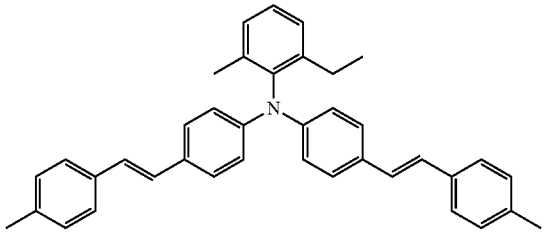

(HT-4)

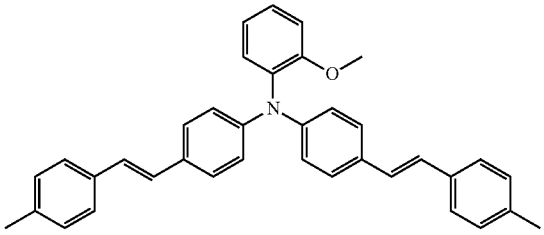

(HT-5)

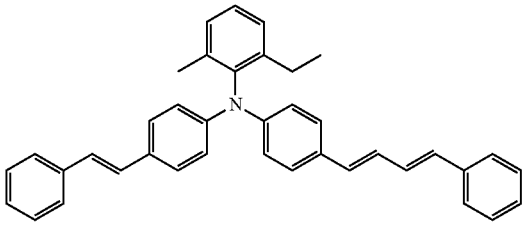

(HT-6)

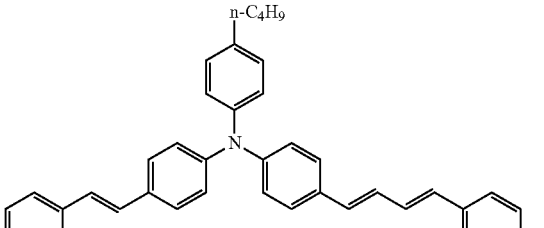

(HT-7)

(HT-8)

(HT-9)

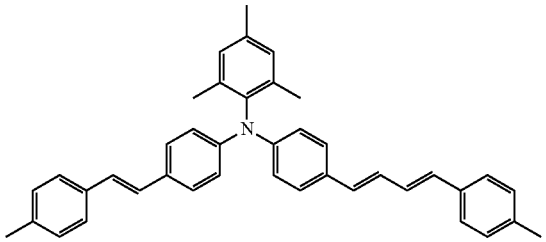

(HT-10)

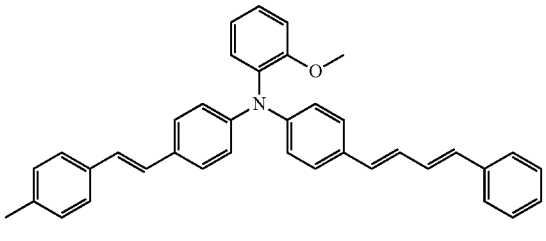

(HT-11)

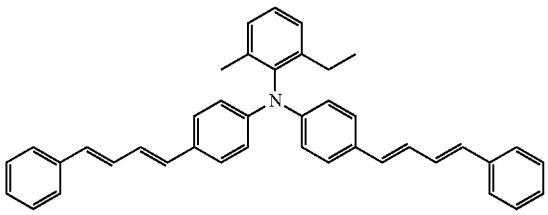

(HT-12)

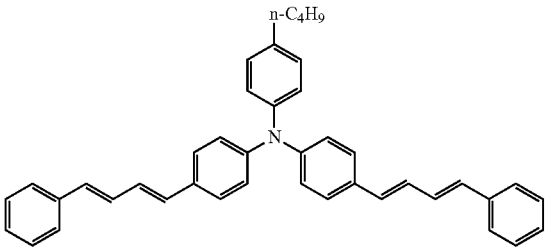

-continued (HT-11)

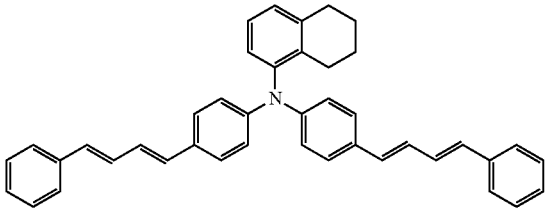

(HT-12)

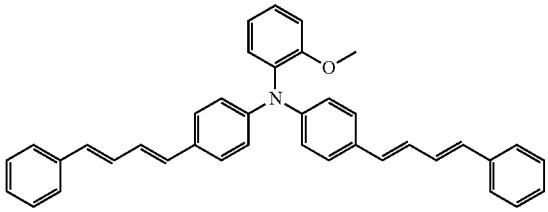

(HT-13)

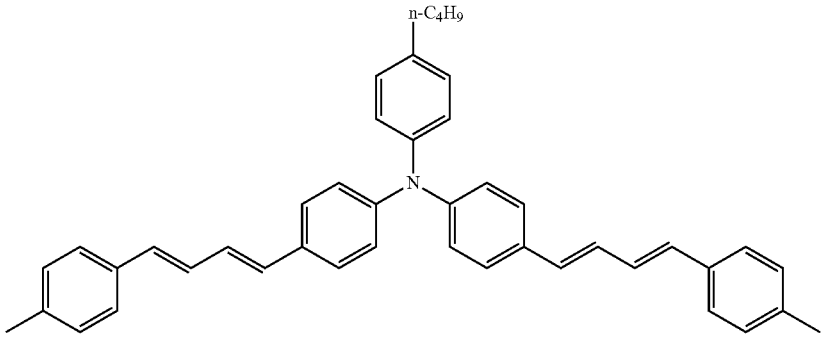

In addition to the triphenylamine derivative (1), an additional hole transport material other than the triphenylamine derivative (1) may be used in combination with the triphenylamine derivative (1). The additional hole transport material can be selected as appropriate from known hole transport materials.

Examples of the additional hole transport material include: oxadiazole-based compounds such as 2,5-di(4-methylaminophenyl)-1,3,4-oxadiazole; styryl-based compounds such as 9-(4-diethylaminostyryl)anthracene; carbazole-based compounds such as polyvinyl carbazole; organic polysilane compounds; pyrazoline-based compounds such as 1-phenyl-3-(p-dimethylaminophenyppyrazoline; hydrazone-based compounds; triphenylamine-based compounds (triphenylamine-based compounds other than the triphenylamine derivative (1)); nitrogen-containing cyclic compounds such as oxazole-based compounds, isoxazole-based compounds, thiazole-based compounds, imidazole-based compounds, pyrazole-based compounds, and triazole-based compounds; and nitrogen-containing condensed polycyclic compounds such as indole-based compounds and thiadiazole-based compounds. One of the above hole transport materials may be used independently, or two or more of the above hole transport materials may be used in combination.

The amount of the hole transport material(s) is preferably at least 10 parts by mass and no greater than 200 parts by mass relative to 100 parts by mass of the binder resin in the photosensitive layer, and more preferably at least 10 parts by mass and no greater than 100 parts by mass.

The amount of the triphenylamine derivative (1) in the hole transport material(s) is preferably at least 80% by mass relative to a total mass of the hole transport material(s), more preferably at least 90% by mass, and particularly preferably 100% by mass.

[4. Electron Transport Material]

The electron transport material includes the quinone derivative (2). The quinone derivative (2) is represented by general formula (2).

(2)

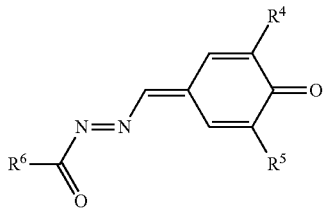

In general formula (2), $R^4$ and $R^5$ each represent, independently of one another, an alkyl group having a carbon number of at least 1 and no greater than 10 and optionally having an aryl group having a carbon number of at least 6 and no greater than 14, a cycloalkyl group having a carbon number of at least 3 and no greater than 10, an alkoxy group having a carbon number of at least 1 and no greater than 6, or an optionally substituted aryl group having a carbon number of at least 6 and no greater than 14. $R^6$ represents an alkyl group having a carbon number of at least 1 and no greater than 10 and optionally having an aryl group having a carbon number of at least 6 and no greater than 14, a cycloalkyl group having a carbon number of at least 3 and no greater than 10, an alkoxy group having a carbon number of at least 1 and no greater than 6, an optionally substituted aryl group having a carbon number of at least 6 and no greater than 14, or an optionally substituted heterocyclic group.

In general formula (2), an alkyl group having a carbon number of at least 1 and no greater than 10 and represented by $R^4$ or $R^5$ is preferably an alkyl group having a carbon number of at least 1 and no greater than 6, more preferably an alkyl group having a carbon number of at least 1 and no greater than 4, and further preferably a methyl group or a t-butyl group. An alkyl group having a carbon number of at least 1 and no greater 10 and represented by $R^4$ or $R^5$ may optionally have a substituent. Examples of substituents such as above include a halogen atom, a hydroxyl group, an alkoxy group having a carbon number of at least 1 and no greater than 4, an aryl group having a carbon number of at least 6 and no greater than 14, and a cyano group. An aryl group having a carbon number of at least 6 and no greater than 14 is preferable. Examples of alkyl groups having a carbon number of at least 1 and no greater than 10 and having an aryl group having a carbon number of at least 6 and no greater than 14 include a benzyl group, an α-methylbenzyl group, a phenethyl group, a styryl group, a cinnamyl group, a 3-phenylpropyl group, a 4-phenylbutyl group, a 5-phenylpentyl group, and a 6-phenylhexyl group.

In general formula (2), an aryl group having a carbon number of at least 6 and no greater than 14 and represented by $R^4$ or $R^5$ may optionally have a substituent. Examples of substituents such as above include a halogen atom, a nitro group, an alkyl group having a carbon number of at least 1 and no greater than 6, an alkoxy group having a carbon number of at least 1 and no greater than 6, or a cycloalkyl group having a carbon number of at least 3 and no greater than 10.

In general formula (2), an alkyl group having a carbon number of at least 1 and no greater than 10 and represented by $R^6$ is preferably an alkyl group having a carbon number of at least 1 and no greater than 6, more preferably an alkyl group having a carbon number of at least 1 and no greater than 4, and further preferably a methyl group. An alkyl group having a carbon number of at least 1 and no greater 10 and represented by $R^6$ may optionally have a substituent. Examples of substituents such as above include a halogen atom, a hydroxyl group, an alkoxy group having a carbon number of at least 1 and no greater than 4, an aryl group having a carbon number of at least 6 and no greater than 14, and a cyano group. An aryl group having a carbon number of at least 6 and no greater than 14 is preferable. Examples of alkyl groups having a carbon number of at least 1 and no greater than 10 and having an aryl group having a carbon number of at least 6 and no greater than 14 include a benzyl group, an α-methylbenzyl group, a phenethyl group, a styryl group, a cinnamyl group, a 3-phenylpropyl group, a 4-phenylbutyl group, a 5-phenylpentyl group, and a 6-phenylhexyl group.

In general formula (2), an aryl group having a carbon number of at least 6 and no greater than 14 and represented by $R^6$ is preferably a phenyl group. The aryl group having a carbon number of at least 6 and no greater than 14 may optionally have a substituent. Examples of substituents such as above include a halogen atom, a nitro group, an alkyl group having a carbon number of at least 1 and no greater than 6, an alkoxy group having a carbon number of at least 1 and no greater than 6, and a cycloalkyl group having a carbon number of at least 3 and no greater than 10. An alkyl group having a carbon number of at least 1 and no greater than 4, a halogen atom, an alkoxy group having a carbon number of at least 1 and no greater than 4, or a nitro group is preferable. A t-butyl group, a chlorine atom, a methoxy group, or a nitro group is further preferable. When the aryl group having a carbon number of at least 6 and no greater than 14 is a phenyl group, the substitution position of the substituent is preferably an ortho position or a para position of the phenyl group relative to a carbonyl group.

In general formula (2), it is preferable that: $R^4$ and $R^5$ each represent an alkyl group having a carbon number of at least 1 and no greater than 4; and $R^6$ represents an alkyl group having a carbon number of at least 1 and no greater than 3, a heterocyclic group, or an aryl group having a carbon number of at least 6 and no greater than 14 and optionally having an alkyl group having a carbon number of at least 1 and no greater than 4, a halogen atom, an alkoxy group having a carbon number of at least 1 and no greater than 4, or a nitro group.

In general formula (2), a heterocyclic group represented by $R^3$ is preferably a pyridyl group and more preferably a 4-pyridyl group. The heterocyclic group represented by $R^3$ may optionally have a substituent. Examples of substituents such as above include a halogen atom, a hydroxyl group, an alkyl group having a carbon number of at least 1 and no greater than 4, an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group having an alkoxy group having a carbon number of at least 1 and no greater than 4, and a phenoxycarbonyl group.

Specific examples of the quinone derivative (2) include quinone derivatives represented by chemical formulas (2-1) to (2-7) (also referred to below as quinone derivatives (2-1) to (2-7), respectively).

(2-1)

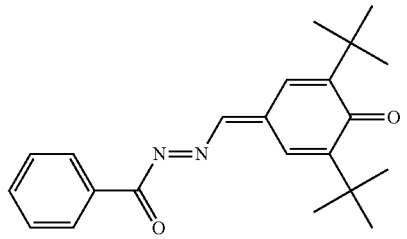

(2-2)

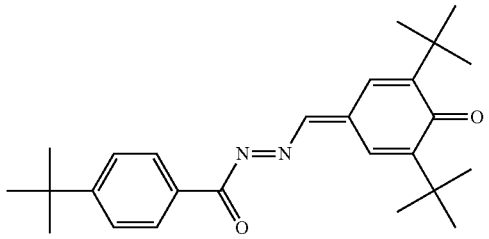

(2-3)

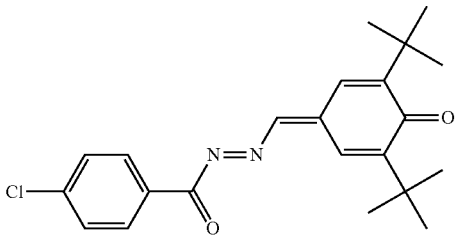

(2-4)

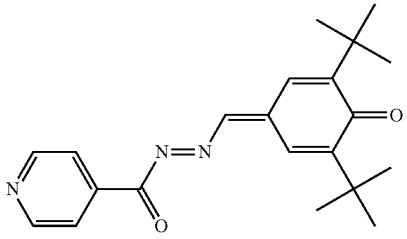

-continued (2-5)

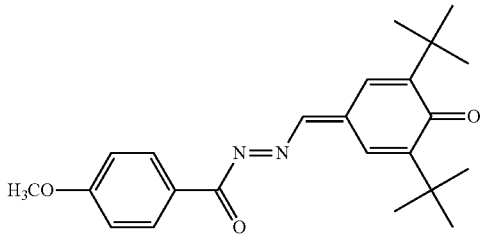

(2-6)

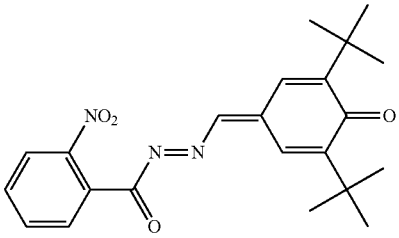

(2-7)

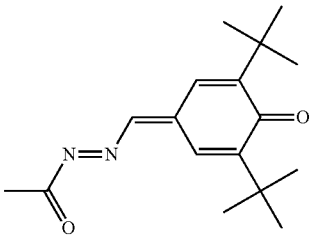

In addition to the quinone derivative (2), an additional electron transport material other than the quinone derivative (2) may be used in combination with the quinone derivative (2). The additional electron transport material can be selected as appropriate from known electron transport materials.

Examples of the additional electron transport material include quinone-based compounds (quinone-based compounds other than the quinone derivative (2)), diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds other than the quinone derivative (2) include diphenoquinone-based compounds, azoquinone-based compounds, anthraquinone-based compounds, naphthoquinone-based compounds, nitroanthraquinone-based compounds, and dinitroanthraquinone-based compounds. One of the electron transport materials listed above may be used independently, or two or more of the electron transport materials listed above may be used in combination.

The amount of the electron transport material(s) is preferably at least 5 parts by mass and no greater than 100 parts by mass relative to 100 parts by mass of the binder resin in the photosensitive layer, and more preferably at least 10 parts by mass and no greater than 80 parts by mass.

The amount of the quinone derivative (2) in the electron transport material(s) is preferably at least 80% by mass relative to a total mass of the electron transport material(s), more preferably at least 90% by mass, and particularly preferably 100% by mass.

(Synthesis Method of Quinone Derivative (2))

The quinone derivative (2) can be synthesized by a reaction represented by reaction formula (1) (also referred to below as reaction (1)). Reaction (1) includes a reaction represented by reaction formula (X) (also referred to below as reaction (X)) and a reaction represented by reaction formula (Y) (also referred to below as reaction (Y)). $R^4$, $R^5$, and $R^6$ in reaction formulas (X) and (Y) are the same as $R^4$, $R^5$, and $R^6$ in general formula (2), respectively.

Reaction (1)

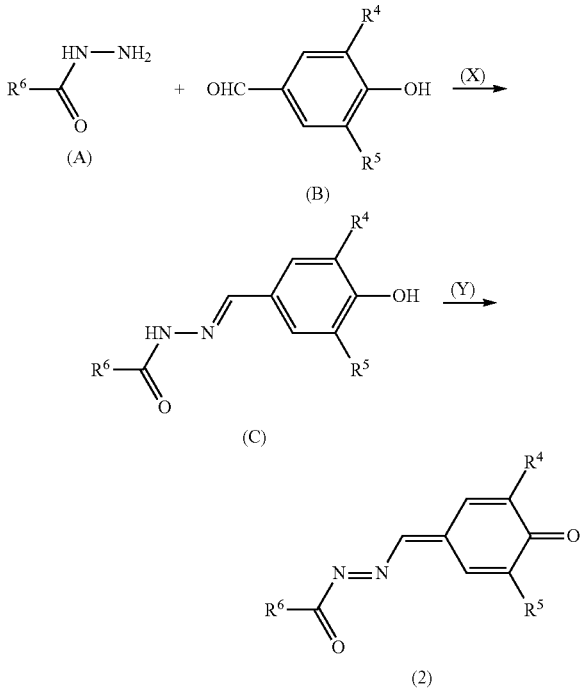

[Reaction (X): Synthesis of Compound (C)]

A specific amount of an acid (for example, p-toluenesulfonic acid) is added to a solution in which compounds (A) and (B) are dissolved in an organic solvent (for example, toluene), and dehydration is performed thereon under reflux for a specific time period. Next, water is added thereto and an organic layer is extracted. The extracted organic layer is dried to evaporate the solvent under reduced pressure to give a compound (C). A reaction ratio between the compounds (A) and (B) (molar ratio=compound (A): compound (B)) is preferably 4:1 to 1:4 and more preferably 2:1 to 1:2.

[Reaction (Y): Synthesis of Quinone Derivative (2)]

A specific amount of an oxidant (for example, potassium permanganate) is added to a solution in which the compound (C) is dissolved in an organic solvent (for example, chloroform), and the resultant solution is stirred for a specific time period at room temperature (for example, 25° C.) for an oxidation reaction. After the oxidation reaction, an unreacted portion of the oxidant is removed by filtration of the solution. A resultant substance is purified by a column chromatography or the like to give the quinone derivative (2).

[5. Binder Resin]

The binder resin disperses and fixes the charge generating material and the like in the photosensitive layer. Examples of the binder resin include thermoplastic resins, thermosetting resins, and photocurable resins. Examples of thermoplastic resins include polycarbonate resins (specific examples include bisphenol Z polycarbonate resin, bisphenol ZC polycarbonate resin, bisphenol C polycarbonate resin, and bisphenol A polycarbonate resin), polyarylate resins, styrene-butadiene resins, styrene-acrylonitrile resins, styrene-maleic acid resins, acrylic acid-based resins, styrene-acrylic acid-based resins, polyethylene resins, ethylene-vinyl acetate resins, chlorinated polyethylene resins, polyvinyl chloride resins, polypropylene resins, ionomer resins, vinyl chloride-vinyl acetate resins, alkyd resins, polyamide resins, polyurethane resins, polysulfone resins, diallyl phthalate resins, ketone resins, polyvinyl butyral resins, and polyether resins. Examples of thermosetting resins include silicone resins, epoxy resins, phenolic resins, urea resins, melamine resins, and other cross-linkable thermosetting resins. Examples of photocurable resins include epoxy-acrylic acid-based resins and urethane-acrylic acid-based resins. Among the binder resins listed above, a polycarbonate resin is preferable and a bisphenol Z polycarbonate resin is more preferable. The bisphenol Z polycarbonate resin includes a repeating unit represented by chemical formula (Resin-1). In the following description, a binder resin including the repeating unit represented by chemical formula (Resin-1) may be referred to as a bisphenol Z polycarbonate resin (Resin-1). Note that one binder resin may be used independently or two or more binder resins may be used in combination.

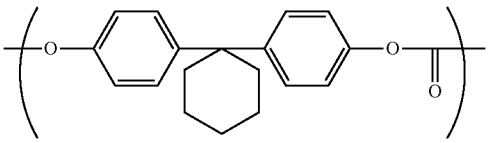

(Resin-1)

The binder resin preferably has a viscosity average molecular weight of at least 40,000, and more preferably at least 40,000 and no greater than 52,500. As a result of the binder resin having a viscosity average molecular weight of at least 40,000, abrasion resistance of the binder resin can be made sufficiently high and the photosensitive layer is hardly abraded. Also, as a result of the binder resin having a viscosity average molecular weight of no greater than 52,500, the binder resin readily dissolves in a solvent in photosensitive layer formation and viscosity of an application liquid for photosensitive layer formation can be made not excessively high. Consequently, formation of the photosensitive layer can be facilitated.

[6. Additive]

The photosensitive layer may contain various additives so long as such additives do not adversely affect electrophotographic characteristics of the photosensitive member. Examples of additives include antidegradants (specific examples include antioxidants, radical scavengers, quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants include hindered phenol, hindered amine, paraphenylenediamine, arylalkane, hydroquinone, spirochromane, spiroindanone, derivatives of any of the above compounds, organosulfur compounds, and organophosphorus compounds.

[7. Intermediate Layer]

The intermediate layer contains for example inorganic particles and a resin (intermediate layer resin). In the presence of the intermediate layer, smooth flow of current generated in light exposure of the photosensitive member can be achieved while insulation can also be maintained to a sufficient degree to prevent leakage current from occurring, thereby suppressing an increase in resistance.

Examples of inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the above-listed inorganic particles may be used independently, or two or more types of the above-listed inorganic particles may be used in combination.

No particular limitations are placed on the intermediate layer resin other than being a resin that can be used to form an intermediate layer.

The intermediate layer may contain various additives so long as such additives do not adversely affect electrophotographic characteristics of the photosensitive member. Examples of the above additive include the same as those listed for the photosensitive layer.

[8. Photosensitive Member Production Method]

The following describes an example of methods for producing the photosensitive member 1 with reference to FIG. 1. The method for producing the photosensitive member 1 involves for example a photosensitive layer formation step. In the photosensitive layer formation step, an application liquid for photosensitive layer formation is applied onto the conductive substrate 2 and a solvent included in the applied application liquid for photosensitive layer formation is removed to form the photosensitive layer 3. The application liquid for photosensitive layer formation includes at least a metal-free phthalocyanine as a charge generating material, the triphenylamine derivative (1) as a hole transport material, the quinone derivative (2) as an electron transport material, a binder resin, and the solvent. The application liquid for photosensitive layer formation is prepared by dissolving or dispersing the metal-free phthalocyanine as a charge generating material, the triphenylamine derivative (1) as a hole transport material, the quinone derivative (2) as an electron transport material, and the binder resin in the solvent. An electron transport material and various additives may optionally be added to the application liquid for photosensitive layer formation as necessary.

No particular limitations are placed on the solvent included in the application liquid for photosensitive layer formation as long as respective components included in the application liquid for photosensitive layer formation can be dissolved or dispersed therein. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, N,N-dimethylformamide (DMF), and dimethyl sulfoxide. One of the solvents listed above may be used independently, or two or more of the solvents listed above may be used in combination. Among the solvents listed above, a solvent other than the halogenated hydrocarbons is preferable in order to improve workability in production of the photosensitive member 1.

The application liquid for photosensitive layer formation is prepared by mixing and dispersing the respective components in the solvent. Mixing or dispersion can be performed for example using a bead mill, a roll mill, a ball mill, an attritor, a paint shaker, or an ultrasonic disperser.

The application liquid for photosensitive layer formation may include for example a surfactant or a leveling agent in order to improve dispersibility of the components or improve surface flatness of a to-be-formed layer.

No specific limitations are placed on a method for applying the application liquid for photosensitive layer formation other than for example enabling uniform application on the conductive substrate 2. Examples of application methods that can be employed include dip coating, spray coating, spin coating, and bar coating.

No specific limitations are placed on a method for removing the solvent included in the application liquid for photosensitive layer formation other than enabling evaporation of the solvent in the application liquid for photosensitive layer formation. Examples of methods that can be employed to remove the solvent include heating, pressure reduction, and a combination of heating and pressure reduction. More specifically, thermal treatment (hot-air drying) using a high-temperature dryer or a reduced-pressure dryer can be employed. The thermal treatment is for example performed for at least 3 minutes and no longer than 120 minutes at a temperature of at least 40° C. and no greater than 150° C.

Note that the method for producing the photosensitive member 1 may additionally include either or both a step of forming the intermediate layer 4 and a step of forming the protective layer 5. A known method is selected as appropriate in each of the step of forming the intermediate layer 4 and the step of forming the protective layer 5.

The photosensitive member 1 is used for example as an image bearing member in an image forming apparatus. An image forming apparatus, which will be described later in the second embodiment, includes a charger that applies direct current voltage to the image bearing member while in contact with the image bearing member.

Through the above, the photosensitive member 1 according to the first embodiment is described with reference to FIG. 1. The surface potential of the photosensitive member 1 according to the first embodiment can be stably maintained in charging.

Second Embodiment: Image Forming Apparatus

The second embodiment relates to an image forming apparatus 6. The following describes the image forming apparatus 6 according to the second embodiment with reference to FIGS. 2 and 3.

The image forming apparatus 6 includes the photosensitive member 1 as an image bearing member. As has been already described, the surface potential of the photosensitive member 1 can be maintained stably in charging. When the surface potential of the photosensitive member 1 is maintained stably in charging, drum scratches are hardly formed and toner filming hardly occurs on the surface of the photosensitive member 1. As a result, occurrence of an image defect resulting from drum scratches or toner filming can be prevented in the image forming apparatus 6 including the photosensitive member 1.

Figure 2:
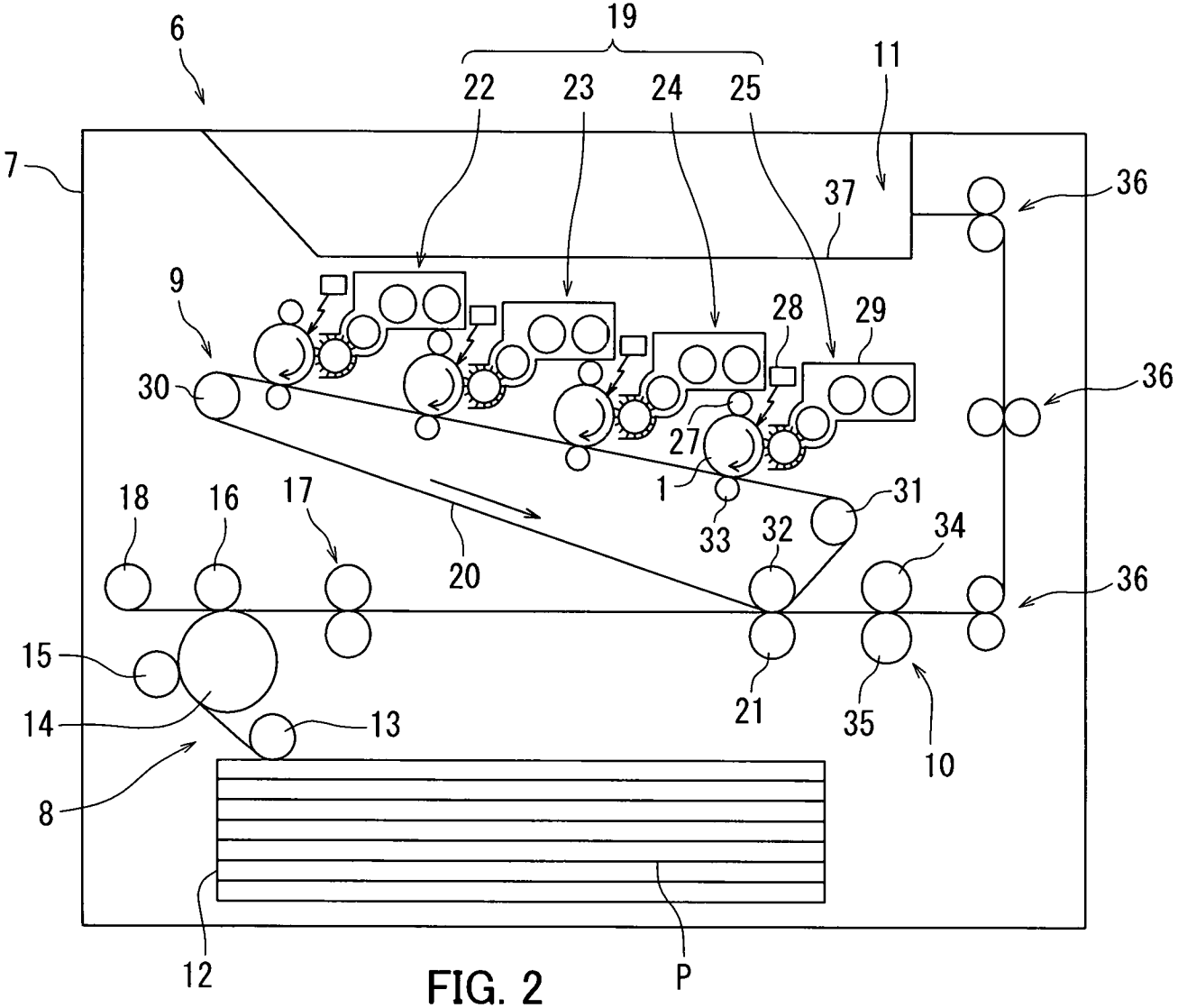
FIG. 2 is a schematic diagram illustrating a configuration of an image forming apparatus according to an example of a second embodiment.

An example in which the image forming apparatus 6 adopts an intermediate transfer process is described below with reference to FIG. 2. Note that an example in which the image forming apparatus 6 adopts a direct transfer process will be described further below. FIG. 2 is a schematic diagram illustrating an example of a configuration of the image forming apparatus 6.

The image forming apparatus 6 includes the photosensitive member 1 as an image bearing member, a charger 27, a light exposure section 28, a development section 29, and a transfer section. The photosensitive member 1 is the photosensitive member 1 described in the first embodiment. The charger 27 charges a surface of the photosensitive member 1. The charger 27 has a positive charging polarity. The light exposure section 28 exposes the surface of the photosensitive member 1 to light while the photosensitive member 1 is charged to form an electrostatic latent image on the surface of the photosensitive member 1. The development section 29 develops the electrostatic latent image into a toner image. The transfer section transfers the toner image from the photosensitive member 1 to a transfer target. In a configuration in which the image forming apparatus 6 adopts the intermediate transfer process, the transfer section is equivalent to a primary transfer roller 33 and a secondary transfer roller 21. Also, the transfer target is equivalent to an intermediate transfer belt 20 and a recording medium (for example, paper P).

No specific limitations are placed on the image forming apparatus 6 other than being an electrophotographic image forming apparatus. The image forming apparatus 6 may for example be a monochrome image forming apparatus or a color image forming apparatus. The image forming apparatus 6 may be a tandem color image forming apparatus such that toners of different colors are used to form toner images in the different colors.

The following describes an example of an image forming apparatus 6 as a tandem color image forming apparatus. The image forming apparatus 6 includes a plurality of the photosensitive members 1 and a plurality of the development sections 29, all of which are arranged side by side in a specific direction. The development sections 29 are each located opposite to a corresponding one of the photosensitive members 1. Each of the development sections 29 includes a development roller. The development roller conveys toner while bearing the toner to supply the toner to the surface of the corresponding photosensitive member 1.

As illustrated in FIG. 2, the image forming apparatus 6 further includes a box-type apparatus housing 7. A paper feed section 8, an image forming section 9, and a fixing section 10 are located inside the apparatus housing 7. The paper feed section 8 feeds paper P. The image forming section 9 transfers the toner images based on image data onto the paper P fed by the paper feed section 8 while conveying the paper P. The fixing section 10 fixes, to the paper P, the toner images that have been transferred onto the paper P by the image forming section 9 and unfixed yet. Furthermore, a paper ejection section 11 is disposed on a top surface of the apparatus housing 7. The paper ejection section 11 ejects the paper P having been subjected to a fixing process by the fixing section 10.

The paper feed section 8 includes a paper feed cassette 12, a first pickup roller 13, paper feed rollers 14, 15, and 16, and a pair of registration rollers 17. The paper feed cassette 12 is insertable into and detachable from the apparatus housing 7. The paper feed cassette 12 can store paper P of various sizes. The first pickup roller 13 is located on an upper left side of the paper feed cassette 12. The first pickup roller 13 picks up paper P stored in the paper feed cassette 12 one sheet at a time. The paper feed rollers 14, 15, and 16 convey the paper P picked up by the first pickup roller 13. The pair of registration rollers 17 temporarily halts the paper P conveyed by the paper feed rollers 14, 15, and 16 and subsequently supplies the paper P to the image forming section 9 at a specific timing.

The paper feed section 8 further includes a manual feed tray (not illustrated) and a second pickup roller 18. The manual feed tray is attached to a left side surface of the apparatus housing 7. The second pickup roller 18 picks up paper P loaded on the manual feed tray. The paper P picked up by the second pickup roller 18 is conveyed by the paper feed rollers 14, 15, and 16 and supplied to the image forming section 9 at the specific timing by the pair of registration rollers 17.

The image forming section 9 includes an image forming unit 19, the intermediate transfer belt 20, and the secondary transfer roller 21. The image forming unit 19 performs primary transfer of toner images onto a surface of the intermediate transfer belt 20 (surface in contact with primary transfer rollers 33). The toner images that undergo primary transfer is formed based on image data transmitted from a higher-level device, such as a computer. The secondary transfer roller 21 performs secondary transfer of the toner images on the intermediate transfer belt 20 onto the paper P fed from the paper feed cassette 12.

In the image forming unit 19, a yellow toner supply unit 25, a magenta toner supply unit 24, a cyan toner supply unit 23, and a black toner supply unit 22 are arranged in the stated order from upstream (right-hand side of FIG. 2) to downstream in terms of a circulation direction of the intermediate transfer belt 20 relative to the yellow toner supply unit 25 as a reference point. The photosensitive members 1 are each provided at a central position of a corresponding one of the toner supply units 22, 23, 24, and 25. The photosensitive members 1 are provided such as to be rotatable in an arrow direction (clockwise). Note that each of the units 22, 23, 24, and 25 may be a process cartridge described later that is attachable to and detachable from a main body of the image forming apparatus 6.

The charger 27, the light exposure section 28, and the development section 29 are located around the photosensitive member 1 in the stated order from upstream in terms of a rotation direction of the photosensitive member 1 relative to the charger 27 as a reference point.

A static eliminator (not illustrated) and a cleaning device (not illustrated) may be provided upstream of the charger 27 in terms of the rotation direction of the photosensitive member 1. Once primary transfer of the toner images onto the intermediate transfer belt 20 is complete, the static eliminator eliminates static electricity from a circumferential surface of the photosensitive member 1. After a portion of the circumferential surface of the photosensitive member 1 has been cleaned by the cleaning device and static electricity has been eliminated from the portion of the circumferential surface by the static eliminator, the portion of the circumferential surface of the photosensitive member 1 returns to a position corresponding to the charger 27 and the charging process is performed anew. In a configuration in which the image forming apparatus 6 includes either or both the cleaning device and the static eliminator, the charger 27, the light exposure section 28, the development section 29, the primary transfer roller 33, the cleaning device, and the static eliminator are arranged in the stated order from upstream in terms of the rotational direction of the photosensitive member 1 relative to the charger 27 as a reference point.

The charger 27 charges the surface of the photosensitive member 1, as described above. Specifically, the charger 27 uniformly charges the circumferential surface of the photosensitive member 1 to the positive polarity as the photosensitive member 1 rotates in the arrow direction. The charger 27 may be a non-contact charger or a contact charger. When the charger 27 is a non-contact charger 27, the charger 27 applies voltage to the photosensitive member 1 while not in contact with the photosensitive member 1. When the charger 27 is a non-contact charger, the charger 27 is for example a corona discharge charger and, more specifically, is for example a corotron charger or a scorotron charger. When the charger 27 is a contact charger, the charger 27 applies voltage to the photosensitive member 1 while in contact with the photosensitive member 1. When the charger 27 is a contact charger, the charger 27 is for example a contact (proximity) discharge charger, and more specifically, is for example a charging roller or a charging brush.

The charging roller may for example passively rotate in accompaniment to rotation of the photosensitive member 1 while in contact with the photosensitive member 1. At least a surface portion of the charging roller is for example formed from a resin. Specifically, the charging roller includes a metal core axially supported to be rotatable, a resin layer coating the metal core, and a voltage application section for applying voltage to the metal core. The charger 27 including a charging roller such as described above charges the surface of the photosensitive member 1 through application of voltage to the metal core by the voltage applying section while in contact with the photosensitive member 1 via the resin layer thereof.

No particular limitations are placed on a resin forming the resin layer of the charging roller as long as the resin enables charging of the surface (circumferential surface) of the photosensitive member 1. Specific examples of resins used to make the resin layer include silicone resins, urethane resins, and silicone modified resins. The resin layer may contain an inorganic filler.

In a configuration in which the image forming apparatus 6 includes the contact charger 27, the surface of the photosensitive member 1 may be exposed to ions having high kinetic energy generated by gap discharge when compared to the image forming apparatus 6 including the non-contact charger 27. For the reason as above, the surface potential of a photosensitive member in the image forming apparatus 6 including the contact charger 27 tends to be unstable. However, the image forming apparatus 6 according to the second embodiment includes the photosensitive members 1 according to the first embodiment, and therefore, the surface potential of the photosensitive members 1 can be maintained stably in charging even in a configuration in which the image forming apparatus 6 includes the contact charger 27.

As a result of the image forming apparatus 6 including the contact charger 27, it is thought that emission of active gases (for example, ozone and nitrogen oxide) generated from the charger 27 can be inhibited. Accordingly, degradation of the photosensitive layer 3 by the active gases can be inhibited while also enabling apparatus design that takes into account use in an office environment.

No specific limitations are placed on voltage applied by the charger 27. Examples of voltages that the charger 27 applies include an alternating current voltage, a composite voltage of an alternating current voltage superimposed on a direct current voltage, and a direct current voltage. Among of all, it is preferable that the charger 27 applies only a direct current voltage. A charger 27 that applies only a direct current voltage is superior in the following points to a charger 27 that applies an alternating current voltage and a charger 27 that applies a composite voltage of an alternating current voltage superimposed on a direct current voltage. When the charger 27 applies only a direct current voltage, a value of the voltage applied to the photosensitive member 1 is constant, and therefore, uniform charging of the surface of the photosensitive member 1 up to a specific potential can be facilitated. Also, an abrasion mount of the photosensitive layer 3 tends to be small in a configuration in which the charger 27 only applies a direct current voltage. As a result, favorable images can be formed.

The charger 27 preferably applies a voltage of at least 1,000 V and no greater than 2,000 V to the photosensitive member 1, more preferably applies a voltage of at least 1,200 V and no greater than 1,800 V, and particularly preferably applies a voltage of at least 1,400 V and no greater than 1,600 V.

A light exposure device is an example of the light exposure section 28, and a more specific example thereof is a laser scanning unit. The light exposure section 28 exposes the surface of the photosensitive member 1 to light while the photosensitive member 1 is charged to form an electrostatic latent image on the surface of the photosensitive member 1. Specifically, the light exposure section 28 irradiates the circumferential surface of the photosensitive member 1 uniformly charged by the charger 27 with laser light based on image data input from a higher-level device such as a personal computer. Through the above, an electrostatic latent image based on the image data is formed on the circumferential surface of the photosensitive member 1.

The development section 29 develops the electrostatic latent image into a toner image. Specifically, the development section 29 forms a toner image based on the image data by supplying toner to a portion of the circumferential surface of the photosensitive member 1 on which the electrostatic latent image has been formed. A development device is an example of the development section 29.

The transfer section (equivalent to the primary transfer rollers 33 and the secondary transfer roller 21) transfers the toner images formed on the surfaces of the photosensitive members 1 onto a transfer target (equivalent to the intermediate transfer belt 20 and the paper P). The intermediate transfer belt 20 is a rotatory body in the shape of an endless belt. The intermediate transfer belt 20 is wound around a drive roller 30, a driven roller 31, a backup roller 32, and the primary transfer rollers 33. The intermediate transfer belt 20 is located such that the surface (contact surface) of the intermediate transfer belt 20 is in contact with the circumferential surface of each of the photosensitive members 1.

The intermediate transfer belt 20 is pressed against each of the photosensitive members 1 by a corresponding one of the primary transfer rollers 33 located opposite to the photosensitive member 1. The intermediate transfer belt 20 is driven to circulate endlessly in an arrow (anticlockwise) direction by the driving roller 30 while in a pressed state. The drive roller 30 is rotationally driven by a drive source, such as a stepping motor, and applies driving force that causes endless circulation of the intermediate transfer belt 20. The driven roller 31, the backup roller 32, and the primary transfer rollers 33 are freely rotatable. The driven roller 31, the backup roller 32, and the primary transfer rollers 33 passively rotate in accompaniment to endless circulation of the intermediate transfer belt 20 by the drive roller 30. The driven roller 31, the backup roller 32, and the primary transfer rollers 33 support the intermediate transfer belt 20 while passively rotating in response to active rotation of the drive roller 30 through the intermediate transfer belt 20.

Each of the primary transfer rollers 33 applies a primary transfer bias (specifically, a bias of opposite polarity to a toner charging polarity) to the intermediate transfer belt 20. As a result, toner images on the respective photosensitive members 1 are transferred (primary transfer) successively onto the intermediate transfer belt 20 that circulates between the photosensitive members 1 and the corresponding primary transfer rollers 33. Note that the toner charging polarity is positive.

The secondary transfer roller 21 applies a secondary transfer bias (more specifically, a bias of opposite polarity to the toner charging polarity) to paper P. As a result, the toner images that have undergone primary transfer onto the intermediate transfer belt 20 are transferred onto the paper P between the secondary transfer roller 21 and the backup roller 32. Through the above, unfixed toner images are transferred onto the paper P.

The fixing section 10 fixes the unfixed toner images that have been transferred onto the paper P in the image forming section 9. The fixing section 10 includes a heating roller 34 and a pressure roller 35. The heating roller 34 is heated by a conductive heating element. The pressure roller 35 is located opposite to the heating roller 34 and has a circumferential surface that is pressed against a circumferential surface of the heating roller 34.

The transferred images that have been transferred onto the paper P by the secondary transfer roller 21 in the image forming section 9 are fixed to the paper P through a fixing process by heat applied to the paper P during the time when the paper P passes between the heating roller 34 and the pressure roller 35. The paper P is ejected to the paper ejection section 11 after being subjected to the fixing process. A plurality of conveyance rollers 36 are provided at appropriate positions between the fixing section 10 and the paper ejection section 11.

The paper ejection section 11 is formed by a recess at the top of the apparatus housing 7. An exit tray 37 that receives ejected paper P is provided on a bottom surface of the recess. Through the above, the image forming apparatus 6 according to an example of the second embodiment is described with reference to FIG. 2.

Figure 3:
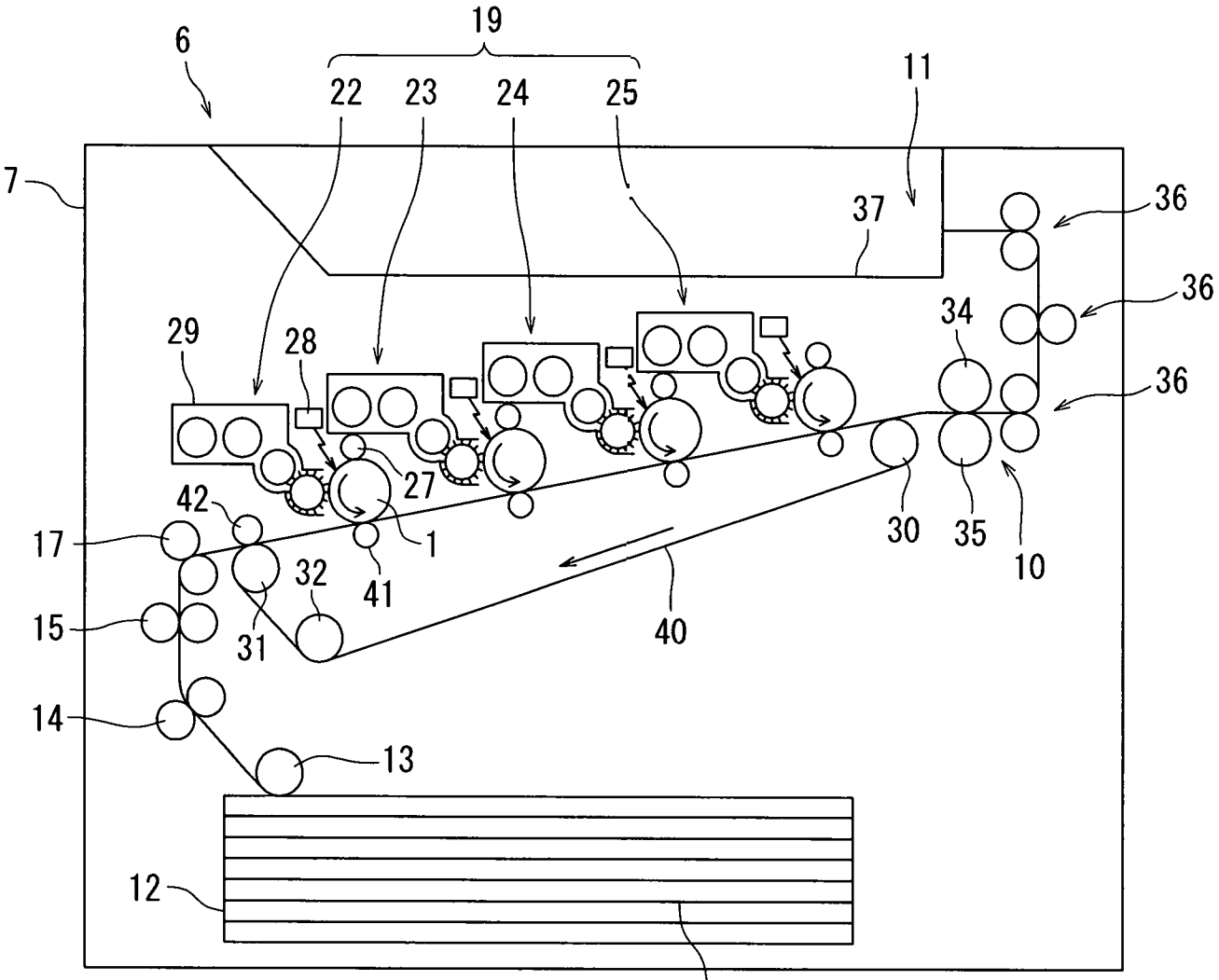
FIG. 3 is a schematic diagram illustrating a configuration of the image forming apparatus in an alternative example of the second embodiment.

The following describes the image forming apparatus 6 according to an alternative example of the second embodiment with reference to FIG. 3. FIG. 3 is a schematic diagram illustrating a configuration of the image forming apparatus 6 in the alternative example of the second embodiment. The image forming apparatus 6 illustrated in FIG. 3 adopts the direct transfer process. In the image forming apparatus 6 illustrated in FIG. 3, the transfer section is equivalent to transfer rollers 41. Also, the transfer target is equivalent to a recording medium (for example, paper P). Elements in FIG. 3 that correspond to elements in FIG. 2 are labelled using the same reference signs as those used in FIG. 2 and explanation thereof is not repeated.

A transfer belt 40 illustrated in FIG. 3 is a rotatory body in the shape of an endless belt. The transfer belt 40 is wound around the drive roller 30, the driven roller 31, the backup roller 32, and the plurality of transfer rollers 41. The transfer belt 40 is disposed such that the surface (contact surface) of the transfer belt 40 is in contact with the circumferential surfaces of the respective photosensitive members 1. The transfer belt 40 is pressed against each of the photosensitive members 1 by a corresponding one of the transfer rollers 41 located opposite to the photosensitive member 1. The transfer belt 40 is driven to circulate endlessly while in a pressed state through the rollers 30, 31, 32, and 41. The drive roller 30 is rotationally driven by a drive source such as a stepping motor and applies driving force that causes endless circulation of the transfer belt 40. The driven roller 31, the backup roller 32, and the transfer rollers 41 are freely rotatable. The driven roller 31, the backup roller 32, and the transfer rollers 41 passively rotate in accompaniment to endless circulation of the transfer belt 40 by the drive roller 30. The rollers 31, 32, and 41 passively rotate while supporting the transfer belt 40. Paper P supplied by the pair of registration rollers 17 is sucked onto the transfer belt 40 by a paper holding roller 42. The paper P sucked onto the transfer belt 40 passes between the photosensitive members 1 and the corresponding transfer rollers 41 as the transfer belt 40 circulates.

The transfer rollers 41 transfer the toner images from the photosensitive members 1 to the paper P. In transfer of each toner image, a corresponding one of the photosensitive members 1 is in contact with the paper P. Specifically, each of the transfer rollers 41 applies a transfer bias (specifically, a bias of opposite polarity to the toner charging polarity) to the paper P sucked onto the transfer belt 40. As a result, the toner images formed on the respective photosensitive members 1 are transferred onto the paper P as the paper P passes between the photosensitive members 1 and the corresponding transfer rollers 41. The transfer belt 40 is driven by the drive roller 30 to circulate in an arrow (i.e., clockwise) direction. As the transfer belt 40 circulates, the paper P sucked onto the transfer belt 40 passes between the photosensitive members 1 and the corresponding transfer rollers 41 in order. As the paper P passes between the photosensitive members 1 and the corresponding transfer rollers 41, toner images of corresponding colors formed on the photosensitive members 1 are successively transferred onto the paper P such that the toner images are superimposed on one another. Thereafter, the photosensitive members 1 further rotate for the next process. Through the above, the image forming apparatus in the alternative example of the second embodiment that adopts the direct transfer process is described with reference to FIG. 3.

As described with reference to FIGS. 2 and 3, the image forming apparatus 6 according to the second embodiment includes the photosensitive members 1 according to the first embodiment. The surface potential of each of the photosensitive members 1 can be stably maintained in charging. Therefore, by including the photosensitive members 1 such as described above, occurrence of an image defect can be inhibited in the image forming apparatus 6 according to the second embodiment.

Third Embodiment: Process Cartridge

A third embodiment relates to a process cartridge. The process cartridge according to the third embodiment includes the photosensitive member 1 according to the first embodiment as an image bearing member. The surface potential of the photosensitive member 1 according to the first embodiment can be stably maintained in charging. As a result, in a configuration in which the image forming apparatus 6 includes the process cartridge according to the third embodiment, it is thought that occurrence of an image defect can be inhibited.

The process cartridge for example has a unitized configuration including the photosensitive member 1 of the first embodiment. The process cartridge may be designed to be freely attachable to and detachable from the image forming apparatus 6 according to the second embodiment. A unitized configuration including for example at least one selected from the group consisting of the charger 27, the light exposure section 28, the development section 29, the transfer section, the cleaning device, and the static eliminator described in the second embodiment in addition to the photosensitive member 1 is employed in the process cartridge.

Through the above, the process cartridge of the third embodiment is described. Occurrence of an image defect can be inhibited when the process cartridge according to the third embodiment is used. Furthermore, a process cartridge such as described above is easy to handle and can therefore be easily and quickly replaced, together with the photosensitive member 1, when sensitivity characteristics or the like of the photosensitive member 1 deteriorate.

EXAMPLES

The following provides more specific description of the present invention through use of Examples. Note that the present invention is not limited to the scope of the Examples.

<1. Materials of Photosensitive Member>

The following charge generating materials, hole transport materials, electron transport materials, and binder resin were prepared as materials for forming photosensitive layers of photosensitive members.

(1-1. Charge Generating Material)

The charge generating materials (CG-1) and (CG-2) were prepared as the charge generating materials. The charge generating material (CG-1) was the metal-free phthalocyanine represented by chemical formula (CG-1) as described in the first embodiment. The charge generating material (CG-1) was in X-form crystal structure.

The charge generating material (CG-2) was a titanyl phthalocyanine represented by chemical formula (CG-2) as described in the first embodiment. The charge generating material (CG-2) was in Y-form crystal structure. Furthermore, the charge generating material (CG-2) had the thermoprofile (C) in a DSC spectrum. Specifically, the charge generating material (CG-2) did not have a peak in a range from 50° C. to 270° C. other than a peak resulting from vaporization of adsorbed water and had at least one peak in a range from 270° C. to 400° C. in a thermal characteristic in the DSC spectrum.

(1-2. Hole Transport Material)

Among the triphenylamine derivatives (1) described in the first embodiment, the triphenylamine derivatives (HT-3), (HT-10), and (HT-12) were prepared as the hole transport materials. A compound represented by chemical formula (HT-21) (also referred to below as a compound (HT-21)) was also prepared.

(HT-21)

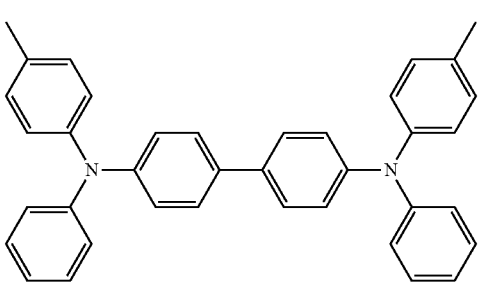

(1-3. Electron Transport Material)

The quinone derivatives (2-1) to (2-7) were synthesized as the electron transport materials.

(Synthesis of Quinone Derivative (2-1))

The quinone derivative (2-1) was obtained through the following reactions (X) and (Y).

Reaction (1)

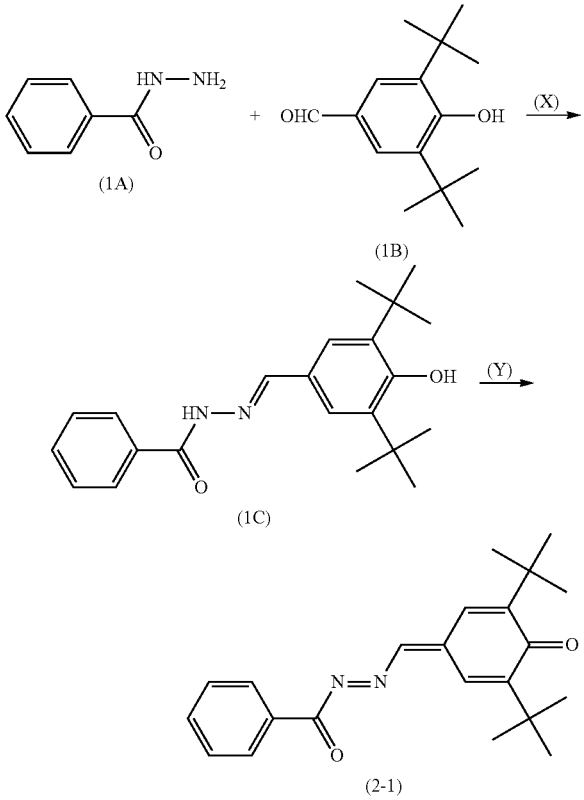

(Reaction (X): Synthesis of Compound (1C))

Into a solution in which 1.36 g (0.01 mol) of a compound (1A) and 2.34 g (0.01 mol) of a compound (1B) were dissolved in 50 mL of toluene, 0.1 mole equivalents of p-toluenesulfonic acid was added. Two-hour dehydration was performed on the resultant solution using a Dean-Stark reaction tube under reflux. After the reaction, water was added and an organic layer was extracted. The extracted organic layer was dried to evaporate toluene under reduced pressure. Thus, a solid compound (1C) was yielded. The compound (1C) was used in reaction (Y-1) directly without being purified. A reaction ratio between the compound (1A) and the compound (1B) [compound (1A): compound (1B)] was 1:1 in terms of a molar ratio.

(Reaction (Y). Synthesis of Quinone Derivative (2-1))

Into a solution in which the compound (1C) was dissolved in 100 mL of chloroform, 1.58 g (0.01 mol) of potassium permanganate was added. The resultant solution was stirred for 12 hours at room temperature for an oxidation reaction. After the oxidation reaction, the chloroform solution was filtered to collect potassium permanganate. The residue was purified by silica gel column chromatography (developing solvent: chloroform/hexane) to obtain 2.45 g of the quinone derivative (2-1) (percentage yield: approximately 70%).

(Synthesis of Quinone Derivatives (2-2) to (2-7))

The quinone derivatives (2-2) to (2-7) were synthesized according to the same method as that for the quinone derivative (2-1) in all aspects other than the following changes. Note that amounts of substances used in synthesis of the quinone derivatives (2-2) to (2-7) were the same as those of the corresponding reactants in synthesis of the quinone derivative (2-1), unless otherwise stated.

Table 1 shows type and amounts of the compounds (A) and (B), type of the compound (C), and type, mass yield, and percentage yield of the quinone derivative (2). The compound (1A) used in the reaction (X) was changed to any one of the compounds (2A) to (7A), and the compound (1B) was changed to either of the compounds (1B) and (2B). As a result of the above changes, compounds (2C) to (7C) were yielded in place of the compound (1C) that was an intermediate product. Each structure of the compounds (2A) to (7A), (2B), and (2A) to (7A) was shown below. In Table 1, the percentage yield of the quinone derivative (2) indicates a percentage yield thereof yielded from the compound (A).

TABLE 1

| Reactions (X) and (Y) | | | | | | | | | |
|---|---|---|---|---|---|---|---|---|---|
| | | | | | | | Quinone derivative (2) | | |
| Compound (A) | | | Compound (B) | | | | | Mass | Percentage |
| Type | Amount [g] | Amount [mol] | Type | Amount [g] | Amount [mol] | Compound (C) Type | Type | yield [g] | yield [mol %] |
| 1A | 1.36 | 0.01 | 1B | 2.34 | 0.01 | 1C | 2-1 | 2.45 | 70 |
| 2A | 1.92 | 0.01 | 1B | 2.34 | 0.01 | 2C | 2-2 | 2.64 | 65 |
| 3A | 1.70 | 0.01 | 1B | 2.34 | 0.01 | 3C | 2-3 | 2.69 | 70 |
| 4A | 1.37 | 0.01 | 1B | 2.34 | 0.01 | 4C | 2-4 | 2.53 | 72 |
| 5A | 1.66 | 0.01 | 1B | 2.34 | 0.01 | 5C | 2-5 | 2.66 | 70 |
| 6A | 1.81 | 0.01 | 2B | 1.50 | 0.01 | 6C | 2-6 | 1.87 | 60 |
| 7A | 0.74 | 0.01 | 1B | 2.34 | 0.01 | 7C | 2-7 | 1.87 | 65 |

(2A)

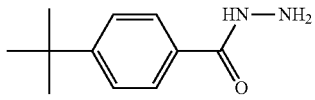

-continued (3A)

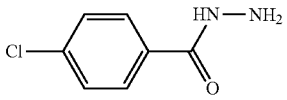

(4A)

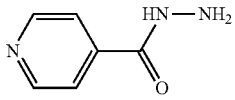

(5A)

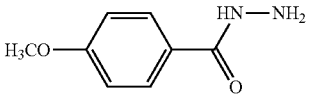

(6A)

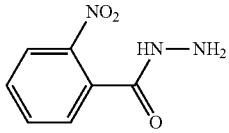

(7A)

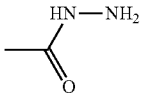

(2B)

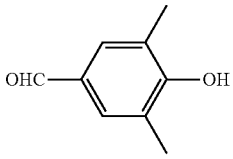

(2C)

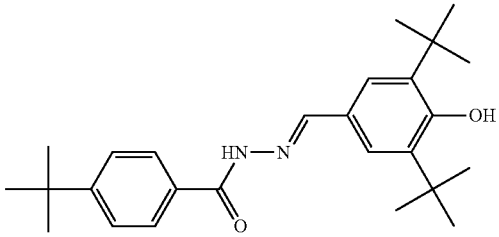

(3C)

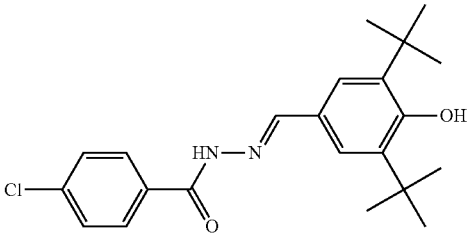

(4C)

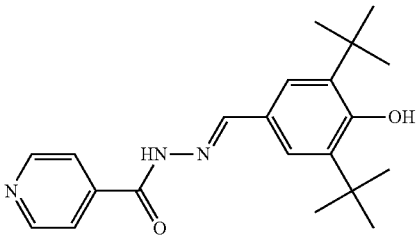

-continued (5C)

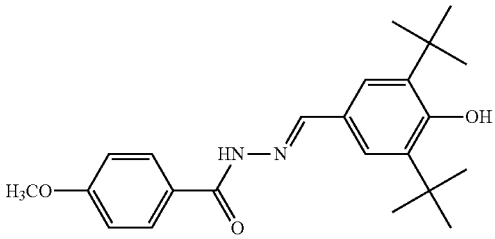

(6C)

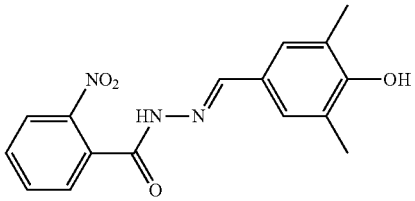

(7C)

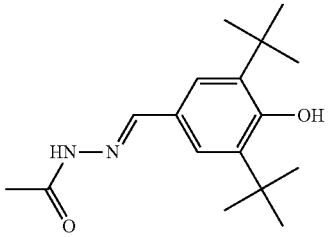

Next, a $^1$H-NMR spectrum of each of the synthesized quinone derivatives (2-1) to (2-7) was measured using a proton nuclear magnetic resonance spectrometer (product of JASCO Corporation, 300 MHz). $CDCl_3$ was used as a solvent. Tetramethylsilane (TMS) was used as an internal standard sample. Among the synthesized quinone derivatives, the quinone derivative (2-1) will be described as a representative example.

Figure 4:
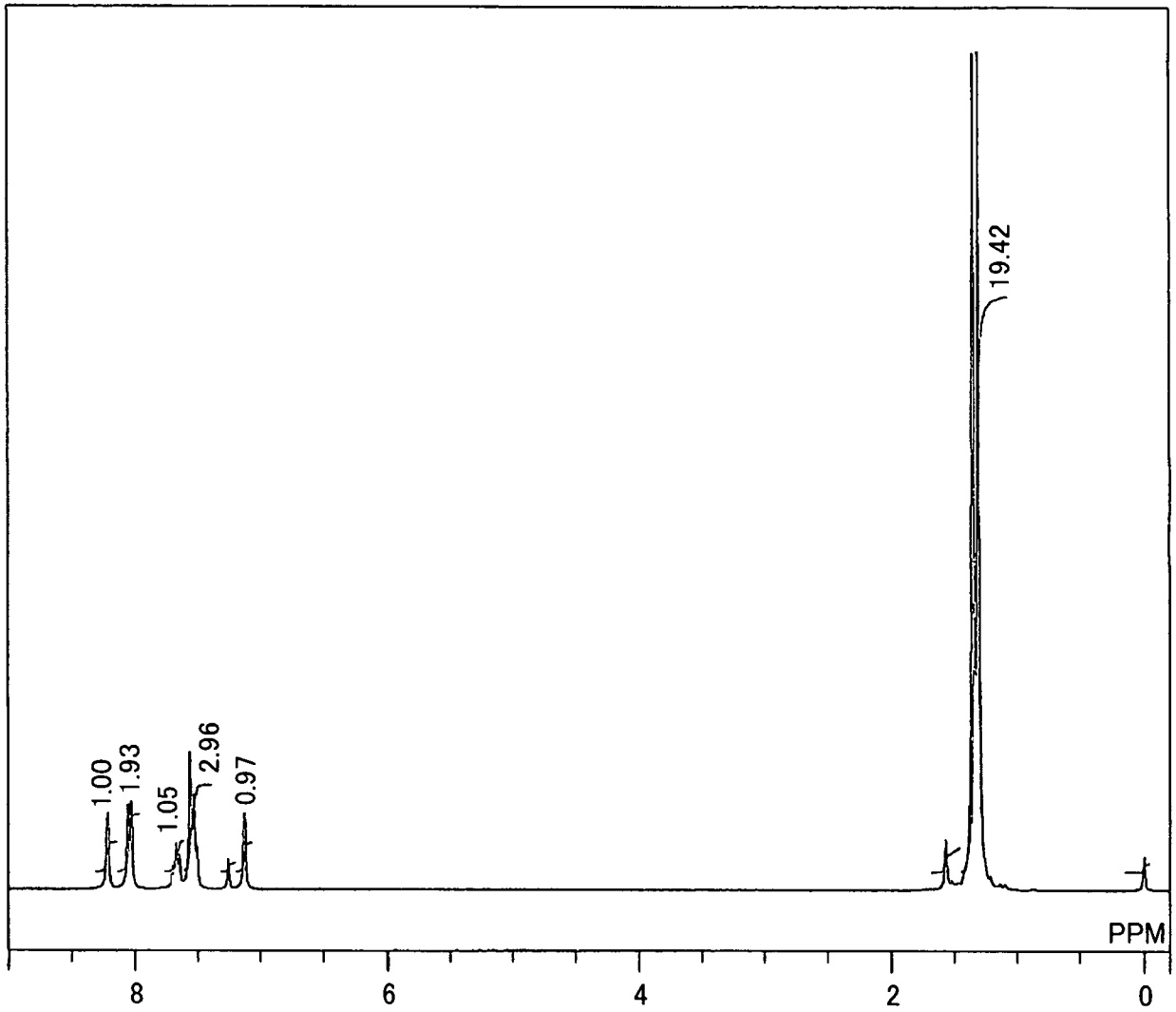
FIG. 4 is a $^1$H-NMR spectrum of a quinone derivative (2-1) according to the first embodiment.

FIG. 4 shows a $^1$H-NMR spectrum of the quinone derivative (2-1). In FIG. 4, the vertical axis represents signal intensity while the horizontal axis represents a chemical shift value (ppm). The following indicates chemical shift values of the quinone derivative (2-1).

Quinone derivative (2-1): $^1$H-NMR 8.22 (s, 1H), 8.03 (d, 2H), 7.49-7.70 (m, 4H), 7.13 (s, 1H), 1.35 (s, 9H), 1.31 (s, 9H).

It was confirmed from the $^1$H-NMR spectrum and the chemical shift values that the quinone derivative (2-1) was synthesized. In a similar manner, it was also confirmed from $^1$H-NMR spectra and chemical shift values of the quinone derivatives (2-2) to (2-7) that the quinone derivatives (2-2) to (2-7) were synthesized.

(Preparation of Compounds (ET-1) and (ET-2))

A compound represented by chemical formula (ET-1) (also referred to below as a compound (ET-1)) and a compound represented by chemical formula (ET-2) (also referred to below as a compound (ET-2)) were also prepared as the electron transport materials.

(ET-1)

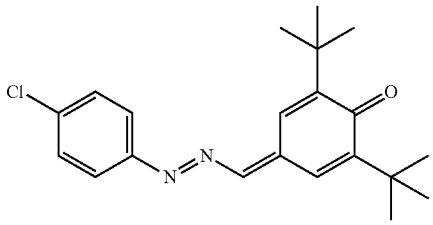

(ET-2)

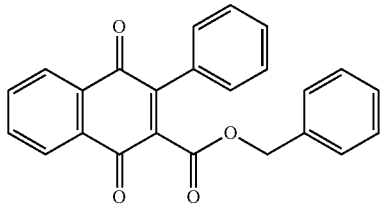

(1-4. Binder Resin)

The bisphenol Z polycarbonate resin (Resin-1) described in the first embodiment was prepared as the binder resin.

<2. Photosensitive Member Production Method>

Photosensitive members (A-1) to (A-21) and (B-1) to (B-22) were produced using the materials prepared for forming photosensitive layers of the photosensitive members.

(Production of Photosensitive Member (A-1))

A vessel was charged with 5 parts by mass of the charge generating material (CG-1), 50 parts by mass of the triphenylamine derivative (HT-1) as a hole transport material, 35 parts by mass of the compound (ET-1) as an electron transport material, 100 parts by mass of the binder resin (Resin-la), and 750 parts by mass of tetrahydrofuran as a solvent. The vessel contents were mixed and dispersed for 50 hours using a ball mill to prepare an application liquid for photosensitive layer formation.

The application liquid for photosensitive layer formation was applied onto a conductive substrate by dip coating to form a film of the application liquid on the conductive substrate. Subsequently, drying was performed for 40 minutes at 100° C. to remove tetrahydrofuran from the film of the application liquid. Through the above, the photosensitive member (A-1) was produced that included a photosensitive layer with a thickness of 35 μm on the conductive substrate.

(Production of Photosensitive Members (A-2) to (A-21) and (B-1) to (B-22))

Photosensitive members (A-2) to (A-21) and (B-1) to (B-22) were produced according to the same method as that for the photosensitive member (A-1) in all aspects other than the following changes. In place of the charge generating material (CG-1), the quinone derivative (2-1) as a hole transport material, the compound represented by chemical formula (ET-1) as an electron transport material, each of which was used for producing the photosensitive member (A-1), charge generating materials (CGM), hole transport materials (HTM), electron transport materials (ETM) of types shown in Tables 2 and 3, and the binder resin were used.

<3. Evaluation for Photosensitive Members>

(3-1. Evaluation of Charge Stability)

Evaluation of stability of surface potential in charging (charge stability) was performed on each of the photosensitive members (A-1) to (A-21) and (B-1) to (B-22).

The photosensitive member was fitted in an image forming apparatus ("FS-C5250DN", product of KYOCERA Document Solutions Inc.). The image forming apparatus included a contact charging roller for applying a direct current voltage as a charger. The charging roller as the charger was to charge the surface of the photosensitive member while in contact at a chargeable sleeve thereof with the photosensitive member. The chargeable sleeve was made from a chargeable rubber of an epichlorohydrin resin in which conductive carbon was dispersed. The charger was set at a charge voltage of +1.4 kV.

The charge voltage was continuously applied to the photosensitive member for 30 minutes using the charger. During application of the charge voltage to the photosensitive member for 30 minutes, the surface potential of the photosensitive member was continuously measured. The surface potential of the photosensitive member directly after a start of 30-minute application of the charge voltage to the photosensitive member was +570±30 V. A maximum value and a minimum value of the surface potential of the photosensitive member measured in the 30-minute charge voltage application to the photosensitive member were taken to be $V_0$ (unit: V) and $V_1$ (unit: V), respectively. Note that the measurement was performed in an environment at a temperature of 23° C. and a relative humidity of 50%.

A difference $\Delta V_0$ in surface potential was calculated from the maximum value $V_0$ and the minimum value $V_1$ of the measured surface potential of the photosensitive member using an expression "$\Delta V_0 = V_1 - V_0$". Tables 2 and 3 show differences $\Delta V_0$ in surface potential of the photosensitive members. Note that a smaller absolute value of the difference $\Delta V_0$ in surface potential indicates more stable surface potential of the photosensitive member in charging.

(3-2. Evaluation of Sensitivity Characteristics and Transfer Memory)

Evaluation of stability of surface potential in charging (charge stability) was performed on each of the photosensitive members (A-1) to (A-21) and (B-1) to (B-22).

The photosensitive member was fitted in an image forming apparatus ("FS-C5250DN", product of KYOCERA Document Solutions Inc.). The image forming apparatus included a contact charging roller for applying a direct current voltage as a charger. The charging roller as the charger was to charge the surface of the photosensitive member while in contact at a chargeable sleeve thereof with the photosensitive member. The chargeable sleeve was made from a chargeable rubber of an epichlorohydrin resin in which conductive carbon was dispersed. A charge voltage of the charger was adjusted to set a charge potential of the photosensitive member at 570 V±10 V.

Subsequently, monochromatic light (wavelength: 780 nm, half-width: 20 nm, light energy: 1.5 μJ/cm$^2$) was taken out from white light of a halogen lamp using a bandpass filter. The surface of the photosensitive member was irradiated with the taken monochromatic light. Respective surface potentials of an exposed region and a non-exposed region of the photosensitive member were measured after 0.5 seconds elapsed from termination of the irradiation. The measured surface potential of the exposed region was taken to be a sensitivity potential $V_L$ (unit: V). The measured surface potential of the non-exposed region was taken to be a blank portion potential $V_3$ (unit: V). Note that the sensitivity potential $V_L$ and the blank portion potential $V_3$ were measured in a state in which no transfer bias was applied. Next, a transfer bias of −2 KV was applied and the surface potential of the non-exposed region was measured in a state in which the transfer bias was applied. The measured surface potential of the non-exposed region was taken to be a blank portion potential $V_4$. A transfer memory potential ΔVtc (unit: V) was calculated from $V_3$ and $V_4$ as measured, using an expression "transfer memory potential $\Delta Vtc=V_4-V_3$". Note that the measurement was performed in an environment at a temperature of 23° C. and a relative humidity of 50%.

Tables 2 and 3 show the sensitivity potentials $V_L$ and the transfer memory potentials ΔVtc as obtained. Note that a smaller value of the sensitivity potential $V_L$ indicates the photosensitive member being more excellent in sensitivity characteristics. A smaller absolute value of the transfer memory potential ΔVtc indicates occurrence of transfer memory being more prevented.

(3-3. Image Evaluation)

Image evaluation was performed on each of the photosensitive members (A-1) to (A-21) and (B-1) to (B-22).

The photosensitive member was fitted in an image forming apparatus ("FS-C5250DN", product of KYOCERA Document Solutions Inc.). The image forming apparatus included a contact charging roller for applying a direct current voltage as a charger. The charging roller as the charger was to charge the surface of the photosensitive member while in contact at a chargeable sleeve thereof with the photosensitive member. The chargeable sleeve was made from a chargeable rubber of an epichlorohydrin resin in which conductive carbon was dispersed. A charge voltage applied by the charger to the photosensitive member was adjusted to set a surface potential of the photosensitive member at 570 V±10 V.

An image A was successively printed on 50,000 sheets of paper using the image forming apparatus. The image A was a character image having a coverage rate of 5%. The printing of the image A on the 50,000 sheets of paper was performed in a normal-temperature and normal-humidity environment (temperature: 23° C., relative humidity: 50%). Subsequently, an image B was printed on a sheet of paper using the image forming apparatus in a normal-temperature and normal-humidity environment (temperature: 23° C., relative humidity: 50%). The image B included a halftone portion and a blank portion. The paper on which the image B had been formed was used as an evaluation sample in the normal-temperature and normal-humidity environment. Subsequently, the image B was printed on one sheet of paper using the image forming apparatus in a low-temperature and low-humidity environment (temperature: 10° C., relative humidity: 20%). The paper on which the image B had been formed was used as an evaluation sample in the low-temperature and low-humidity environment. Note that the paper used was "KYOCERA Document Solutions Inc. bland paper VM-A4 (A4 size)" available at KYOCERA Document Solutions Inc.

The evaluation sample obtained in the normal-temperature and normal-humidity environment and the evaluation sample obtained in the low-temperature and low-humidity environment were observed visually. Through the observation, the presence or absence of an image defect resulting from a drum scratch and the presence or absence of an image defect resulting from toner filming were confirmed. Electrical characteristics of the photosensitive member can be evaluated using the images as above. Specifically, the less stable the surface potential of a photosensitive member is in charging or the more readily transfer memory tends to occur, the more readily a drum scratch tends to be formed and the more readily toner filming tends to occur on the surface of the photosensitive member. Eventually, an image defect resulting from a drum scratch or toner filming occurs. Upon generation of a drum scratch on the surface of a photosensitive member, a black line tends to appear between the blank portion and the halftone portion of an evaluation sample. Upon occurrence of toner filming on the surface of the photosensitive member, a black line tends to appear in the halftone portion of an evaluation sample.

Next, the photosensitive member was taken out from the image forming apparatus. The surface of the taken photosensitive member was observed at a magnification of 50× using a stereoscopic microscope. In a manner as above, the presence or absence of a drum scratch and occurrence or non-occurrence of toner filming on the surface of the photosensitive member were confirmed.

Image evaluation was performed using results of observation on the evaluation sample in the normal-temperature and normal-humidity environment and the evaluation sample in the low-temperature and low-humidity environment and results of observation on the surfaces of the photosensitive members in accordance with the following evaluation criteria. Tables 2 and 3 show results of image evaluation.

(Evaluation Criteria for Image Evaluation)

PG (particularly good): No drum scratch was formed and no toner filming occurred on the surface of a photosensitive member. No image defect resulting from a drum scratch or toner filming was also observed.

G (good): A drum scratch or toner filming was observed on the surface of a photosensitive member. However, no image defect resulting from the drum scratch or the toner filming was observed.

P (poor): A drum scratch or toner filming was observed on the surface of a photosensitive member. An image defect resulting from the drum scratch or the toner filming was observed in an evaluation sample in the low-temperature and low-humidity environment. No image defect resulting from the drum scratch or the toner filming was observed in an evaluation sample in the normal-temperature and normal-humidity environment.

PP (particularly poor): A drum scratch or toner filming was observed on the surface of a photosensitive member. Image defects resulting from the drum scratch or the toner filming were observed in an evaluation sample in the low-temperature and low-humidity environment and an evaluation sample in the normal-temperature and normal-humidity environment.

In Tables 2 and 3, CGM, HTM, and ETM represent a charge generating material, a hole transport material, and an electron transport material, respectively.

TABLE 2

| | | Material | | | | | | | |
|---|---|---|---|---|---|---|---|---|---|
| | No. | CGM | HTM | ETM | Binder resin | $\Delta V_0$ (V) | $V_L$ (V) | ΔVtc (V) | Image evaluation |
| Example 1 | A-1 | CG-1 | HT-3 | 2-1 | Resin-1 | −73 | +124 | −47 | PG |
| Example 2 | A-2 | CG-1 | HT-3 | 2-2 | Resin-1 | −76 | +120 | −45 | PG |

TABLE 2-continued

| | No. | Material CGM | HTM | ETM | Binder resin | ⊿$V_0$ (V) | $V_L$ (V) | ⊿Vtc (V) | Image evaluation |
|---|---|---|---|---|---|---|---|---|---|
| Example 3 | A-3 | CG-1 | HT-3 | 2-3 | Resin-1 | −75 | +120 | −43 | PG |
| Example 4 | A-4 | CG-1 | HT-3 | 2-4 | Resin-1 | −78 | +124 | −48 | PG |
| Example 5 | A-5 | CG-1 | HT-3 | 2-5 | Resin-1 | −82 | +128 | −47 | PG |
| Example 6 | A-6 | CG-1 | HT-3 | 2-6 | Resin-1 | −84 | +123 | −47 | PG |
| Example 7 | A-7 | CG-1 | HT-3 | 2-7 | Resin-1 | −72 | +125 | −49 | G |
| Example 8 | A-8 | CG-1 | HT-10 | 2-1 | Resin-1 | −75 | +120 | −46 | PG |
| Example 9 | A-9 | CG-1 | HT-10 | 2-2 | Resin-1 | −48 | +116 | −44 | PG |
| Example 10 | A-10 | CG-1 | HT-10 | 2-3 | Resin-1 | −43 | +112 | −42 | PG |
| Example 11 | A-11 | CG-1 | HT-10 | 2-4 | Resin-1 | −55 | +120 | −47 | PG |
| Example 12 | A-12 | CG-1 | HT-10 | 2-5 | Resin-1 | −64 | +125 | −46 | PG |
| Example 13 | A-13 | CG-1 | HT-10 | 2-6 | Resin-1 | −58 | +128 | −46 | PG |
| Example 14 | A-14 | CG-1 | HT-10 | 2-7 | Resin-1 | −68 | +124 | −48 | PG |
| Example 15 | A-15 | CG-1 | HT-12 | 2-1 | Resin-1 | −82 | +118 | −44 | PG |
| Example 16 | A-16 | CG-1 | HT-12 | 2-2 | Resin-1 | −55 | +115 | −43 | PG |
| Example 17 | A-17 | CG-1 | HT-12 | 2-3 | Resin-1 | −52 | +108 | −41 | PG |
| Example 18 | A-18 | CG-1 | HT-12 | 2-4 | Resin-1 | −50 | +118 | −46 | PG |
| Example 19 | A-19 | CG-1 | HT-12 | 2-5 | Resin-1 | −56 | +120 | −44 | PG |
| Example 20 | A-20 | CG-1 | HT-12 | 2-6 | Resin-1 | −60 | +121 | −44 | PG |
| Example 21 | A-21 | CG-1 | HT-12 | 2-7 | Resin-1 | −65 | +123 | −47 | PG |

TABLE 3

| | No. | Material CGM | HTM | ETM | Binder resin | ⊿$V_0$ (V) | $V_L$ (V) | ⊿Vtc (V) | Image evaluation |
|---|---|---|---|---|---|---|---|---|---|
| Comparative Example 1 | B-1 | CG-1 | HT-21 | ET-2 | Resin-1 | −135 | +174 | −65 | PP |
| Comparative Example 2 | B-2 | CG-1 | HT-3 | ET-2 | Resin-1 | −185 | +162 | −58 | PP |
| Comparative Example 3 | B-3 | CG-1 | HT-10 | ET-2 | Resin-1 | −148 | +154 | −55 | PP |
| Comparative Example 4 | B-4 | CG-1 | HT-12 | ET-2 | Resin-1 | −95 | +150 | −50 | P |
| Comparative Example 5 | B-5 | CG-1 | HT-21 | 1-1 | Resin-1 | −182 | +170 | −60 | PP |
| Comparative Example 6 | B-6 | CG-1 | HT-21 | 1-2 | Resin-1 | −145 | +160 | −58 | PP |
| Comparative Example 7 | B-7 | CG-1 | HT-21 | 1-3 | Resin-1 | −140 | +155 | −55 | PP |
| Comparative Example 8 | B-8 | CG-1 | HT-21 | 1-4 | Resin-1 | −185 | +158 | −62 | PP |
| Comparative Example 9 | B-9 | CG-1 | HT-21 | 1-5 | Resin-1 | −195 | +163 | −60 | PP |
| Comparative Example 10 | B-10 | CG-1 | HT-21 | 1-6 | Resin-1 | −168 | +168 | −60 | PP |
| Comparative Example 11 | B-11 | CG-1 | HT-21 | 1-7 | Resin-1 | −155 | +173 | −63 | PP |
| Comparative Example 12 | B-12 | CG-2 | HT-21 | ET-2 | Resin-1 | −152 | +160 | −82 | PP |
| Comparative Example 13 | B-13 | CG-2 | HT-3 | ET-2 | Resin-1 | −140 | +155 | −78 | PP |
| Comparative Example 14 | B-14 | CG-2 | HT-10 | ET-2 | Resin-1 | −135 | +152 | −73 | PP |
| Comparative Example 15 | B-15 | CG-2 | HT-12 | ET-2 | Resin-1 | −128 | +150 | −68 | PP |
| Comparative Example 16 | B-16 | CG-2 | HT-21 | 1-2 | Resin-1 | −128 | +145 | −72 | PP |
| Comparative Example 17 | B-17 | CG-2 | HT-21 | 1-3 | Resin-1 | −123 | +140 | −65 | PP |
| Comparative Example 18 | B-18 | CG-2 | HT-3 | 1-3 | Resin-1 | −64 | +115 | −59 | PP |
| Comparative Example 19 | B-19 | CG-2 | HT-10 | 1-2 | Resin-1 | −42 | +102 | −58 | PP |
| Comparative Example 20 | B-20 | CG-2 | HT-10 | 1-3 | Resin-1 | −68 | +98 | −60 | PP |
| Comparative Example 21 | B-21 | CG-2 | HT-12 | 1-3 | Resin-1 | −70 | +95 | −53 | P |
| Comparative Example 22 | B-22 | CG-1 | HT-21 | ET-1 | Resin-1 | −132 | +186 | −60 | PP |

As shown in Table 2, the photosensitive members (A-1) to (A-21) each included a photosensitive layer containing the compound (CG-1) as a charge generating material. The compound (CG-1) was an X-form metal-free phthalocyanine. The photosensitive layer of each of the photosensitive members (A-1) to (A-21) contained any one of the triphenylamine derivatives (HT-3), (HT-12), and (HT-10) as a hole transport material. The triphenylamine derivatives (HT-3), (HT-12), and (HT-10) each were a triphenylamine derivative represented by general formula (1). Furthermore, the photosensitive layer of each of the photosensitive members (A-1) to (A-21) contained any one of the quinone derivatives (2-1) to (2-7) as an electron transport material. The quinone derivatives (2-1) to (2-7) each were a quinone derivative represented by general formula (2).

As shown in Table 2, differences ($\Delta V_0$) in charge potential of the photosensitive members (A-1) to (A-21) each were at least −84 V and no greater than −43 V. The sensitivity potentials ($V_L$) each were at least +108 V and no greater than +128 V. The differences (ΔVtc) in transfer memory potential each were at least −49 V and no greater than −41 V. Image evaluation was resulted in PG (particularly good) or G (good).

As shown in Table 3, the photosensitive layer of each of the photosensitive members (B-1) to (B-22) contained the compound (CG-1) or (CG-2) as a charge generating material, any one of the triphenylamine derivatives (HT-3), (HT-12), and (HT-10) and the compound (HT-21) as a hole transport material, and any one of the quinone derivatives (2-1) to (2-7) and the compounds (ET-1) and (ET-2) as an electron transport material. Specifically, the photosensitive layer of each of the photosensitive members (B-12) to (B-21) contained the compound (CG-2) as a charge generating material. The compound (CG-2) was not an X-form metal-free phthalocyanine. The photosensitive layer of each of the photosensitive members (B-1), (B-5) to (B-12), (B-16), (B-17), and (B-22) contained the compound (HT-21) as a hole transport material. The compound (HT-21) was not a triphenylamine derivative represented by general formula (1). The photosensitive layer of each of the photosensitive members (B-1) to (B-4), (B-12) to (B-15), and (B-22) contained the compound (ET-1) or (ET-2) as an electron transport material. Both the compounds (ET-1) and (ET-2) were not a quinone derivative represented by general formula (2).

As shown in Table 3, differences ($\Delta V_0$) in charge potential of the photosensitive members (B-1) to (B-17) each were at least −195 V and no greater than −95 V and sensitivity potentials ($V_L$) thereof each were at least +140 V and no greater than +174 V. Differences (ΔVtc) in transfer memory potential of the photosensitive members (B-1) to (B-22) each were at least −82 V and no greater than −50 V. Image evaluation resulted in PP (particularly poor) or P (poor).

It is evident from the above that the electrical characteristics (charge stability, sensitivity characteristics, and a characteristic capable of preventing occurrence of transfer memory) were improved with use of any of the photosensitive members (A-1) to (A-21) when compared to use of any of the photosensitive members (B-1) to (B-22). Furthermore, it is evident that occurrence of an image defect derived from electrical characteristics can be inhibited in an image forming apparatus including any of the photosensitive members (A-1) to (A-21) when compared to an image forming apparatus including any of the photosensitive members (B-1) to (B-22).

The above indicates that the electrical characteristics were improved and occurrence of transfer memory was prevented with use of the photosensitive member according to the present invention, and also indicates that occurrence of an image defect was inhibited in an image forming apparatus including such a photosensitive member.

INDUSTRIAL APPLICABILITY

The photosensitive member according to the present invention can be favorably used as an electrophotographic photosensitive member.

The invention claimed is:

1. An electrophotographic photosensitive member comprising a conductive substrate and a photosensitive layer, wherein the photosensitive layer is a single-layer photosensitive layer, the photosensitive layer contains at least a charge generating material, a hole transport material, an electron transport material, and a binder resin, the charge generating material includes a metal-free phthalocyanine, the hole transport material includes a triphenylamine derivative represented by a general formula (1) shown below, and the electron transport material includes a quinone derivative represented by a general formula (2) shown below, (1)

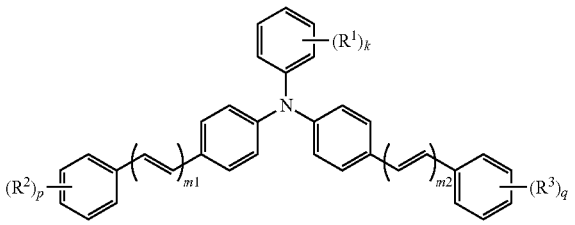

(2)

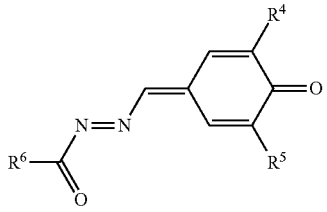

where in the general formula (1), $R^1$, $R^2$, and $R^3$ each represent, independently of one another, an alkyl group having a carbon number of at least 1 and no greater than 4 or an alkoxy group having a carbon number of at least 1 and no greater than 4, k, p, and q each represent, independently of one another, an integer of at least 0 and no greater than 5, m1 and m2 each represent, independently of one another, an integer of at least 1 and no greater than 3, when k represents an integer of at least 2, chemical groups $R^1$ may be the same as or different from one another, when k represents an integer of at least 2, the chemical groups $R^1$ may be bonded together to form a cycloalkyl ring having a carbon number of at least 3 and no greater than 8, when p represents an integer of at least 2, chemical groups $R^2$ may be the same as or different from one another, and when q represents an integer of at least 2, chemical groups $R^3$ may be the same as or different from one another, and in the general formula (2), $R^4$ and $R^5$ each represent, independently of one another, an alkyl group having a carbon number of at least 1 and no greater than 10 and optionally having an aryl group having a carbon number of at least 6 and no greater than 14, a cycloalkyl group having a carbon number of at least 3 and no greater than 10, an alkoxy group having a carbon number of at least 1 and no greater than 6, or an optionally substituted aryl group having a carbon number of at least 6 and no greater than 14, and $R^6$ represents an alkyl group having a carbon number of at least 1 and no greater than 10 and optionally having an aryl group having a carbon number of at least 6 and no greater than 14, a cycloalkyl group having a carbon number of at least 3 and no greater than 10, an alkoxy group having a carbon number of at least 1 and no greater than 6, an optionally substituted aryl group having a carbon number of at least 6 and no greater than 14, or an optionally substituted heterocyclic group.

2. The electrophotographic photosensitive member according to claim 1, wherein in the general formula (1), $R^1$ represents an alkyl group having a carbon number of at least 1 and no greater than 4, an alkoxy group having a carbon number of at least 1 and no greater than 4, or a cycloalkane ring having a carbon number of at least 3 and no greater than 8 and formed through chemical groups $R^1$ being bonded together, $R^2$ and $R^3$ each represent an alkyl group having a carbon number of at least 1 and no greater than 3, k represents an integer of at least 1 and no greater than 3, p and q each represent, independently of one another, 0 or 1, and m1 and m2 each represent, independently of one another, 1 or 2.

3. The electrophotographic photosensitive member according to claim 1, wherein in the general formula (1), $R^1$ represents an alkyl group having a carbon number of at least 1 and no greater than 4 or an alkoxy group having a carbon number of at least 1 and no greater than 3, k represents 1 or 2, $R^2$ and $R^3$ simultaneously represent an alkyl group having a carbon number of at least 1 and no greater than 3, p and q simultaneously represent 0 or 1, and m1 and m2 simultaneously represent 1 or 2.

4. The electrophotographic photosensitive member according to claim 1, wherein the hole transport material includes any of triphenylamine derivatives represented by chemical formulas (HT-3), (HT-10), and (HT-12), (HT-3)

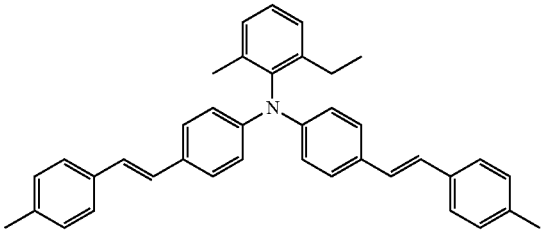

(HT-10)

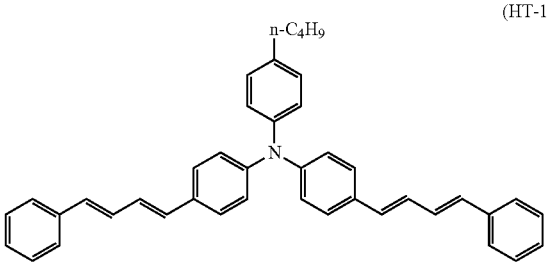

(HT-12)

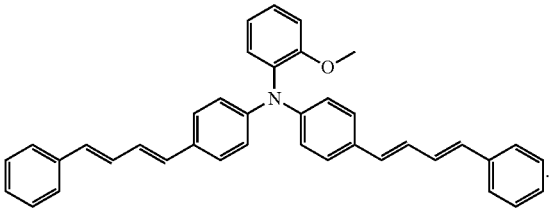

5. The electrophotographic photosensitive member according to claim 1, wherein in the general formula (2), $R^4$ and $R^5$ each represent an alkyl group having a carbon number of at least 1 and no greater than 4, $R^6$ represents an aryl group having a carbon number of at least 6 and no greater than 14 and optionally having a substituent, an alkyl group having a carbon number of at least 1 and no greater than 3, or a heterocyclic group, and the substituent is one selected from the group consisting of an alkyl group having a carbon number of at least 1 and no greater than 4, a halogen atom, an alkoxy group having a carbon number of at least 1 and no greater than 4, and a nitro group.

6. The electrophotographic photosensitive member according to claim 1, wherein the electron transport material includes any of quinone derivatives represented by chemical formulas (2-1) to (2-7), (2-1)

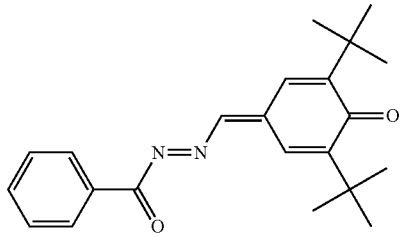

(2-2)

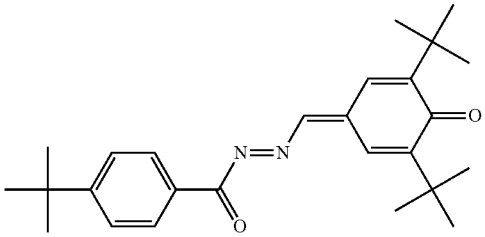

(2-3)

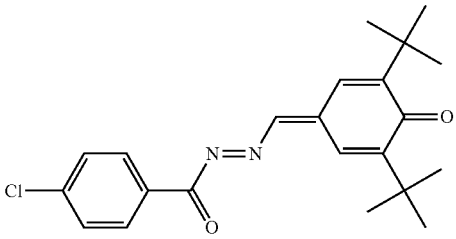

(2-4)

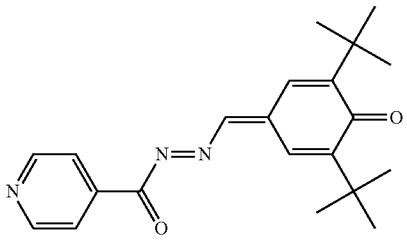

-continued (2-5)

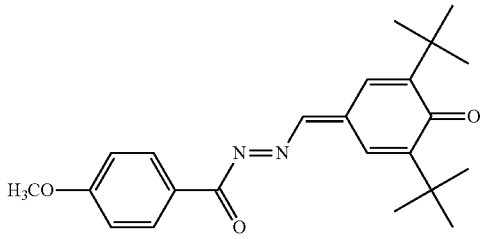

(2-6)

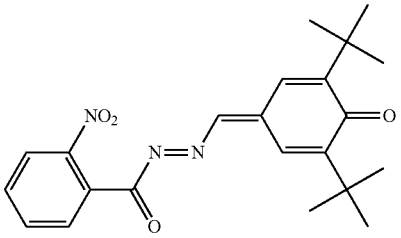

(2-7)

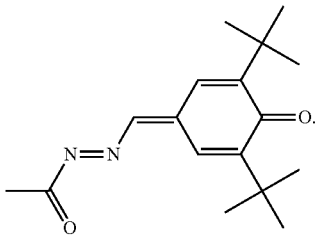

7. A process cartridge comprising the electrophotographic photosensitive member according to claim 1.

8. An image forming apparatus comprising:

an image bearing member;

a charger configured to charge a surface of the image bearing member;

a light exposure section configured to expose the surface of the image bearing member to light while the surface of the image bearing member is charged to form an electrostatic latent image on the surface of the image bearing member;

a development section configured to develop the electrostatic latent image into a toner image; and a transfer section configured to transfer the toner image from the image bearing member to a transfer target, wherein the charger has a positive charging polarity, and the image bearing member is the electrophotographic photosensitive member according to claim 1.

9. The image forming apparatus according to claim 8, wherein the charger applies a direct current voltage to the image bearing member while in contact with the image bearing member.

* * * * *